US009741302B2

(12) United States Patent
Shiomi

(10) Patent No.: US 9,741,302 B2
(45) Date of Patent: Aug. 22, 2017

(54) LIQUID CRYSTAL DISPLAY DEVICE

(71) Applicant: Sharp Kabushiki Kaisha, Osaka-shi, Osaka (JP)

(72) Inventor: Makoto Shiomi, Osaka (JP)

(73) Assignee: SHARP KABUSHIKI KAISHA, Sakai (JP)

( * ) Notice: Subject to any disclaimer, the term of this patent is extended or adjusted under 35 U.S.C. 154(b) by 0 days.

(21) Appl. No.: 14/440,902

(22) PCT Filed: Dec. 26, 2013

(86) PCT No.: PCT/JP2013/084889
§ 371 (c)(1),
(2) Date: May 6, 2015

(87) PCT Pub. No.: WO2014/104193
PCT Pub. Date: Jul. 3, 2014

(65) Prior Publication Data

US 2015/0302814 A1 Oct. 22, 2015

(30) Foreign Application Priority Data

Dec. 26, 2012 (JP) ..... 2012-283561

(51) Int. Cl.
*G09G 3/36* (2006.01)
*G09G 3/20* (2006.01)
(Continued)

(52) U.S. Cl.
CPC ..... *G09G 3/3648* (2013.01); *G09G 3/2003* (2013.01); *G09G 3/3406* (2013.01);
(Continued)

(58) Field of Classification Search
None
See application file for complete search history.

(56) References Cited

U.S. PATENT DOCUMENTS

2004/0169919 A1* 9/2004 Uehara ..... G02B 27/2214 359/443
2006/0221030 A1* 10/2006 Shih ..... G09G 3/3611 345/88

(Continued)

FOREIGN PATENT DOCUMENTS

| | | | |
|---|---|---|---|
| JP | 10-111669 | A | 4/1998 |
| WO | 2006/093163 | A1 | 9/2006 |
| WO | 2008/023602 | A1 | 2/2008 |

OTHER PUBLICATIONS

Official Communication issued in corresponding International Application PCT/JP2013/084889, mailed on Apr. 8, 2014.

*Primary Examiner* — Amare Mengistu
*Assistant Examiner* — Sarvesh J Nadkarni
(74) *Attorney, Agent, or Firm* — Keating & Bennett, LLP

(57) ABSTRACT

In a frame 1, a sum total of luminance of a sub-pixel (SRX) and a sub-pixel (SRx) is caused to correspond to pixel data (DR1) while setting luminance of a sub-pixel (SRX) which is provided in a pixel (PRX) of a picture element (EX) to be higher than luminance of the sub-pixel (SRx) which is close to the sub-pixel (SRX) in the vertical direction in the pixel (PRX), and in a frame 2, a sum total of luminance of the sub-pixel (SRX) and the sub-pixel (SRx) is caused to correspond to pixel data (dR2) while setting luminance of the sub-pixel (SRx) to be higher than luminance of the sub-pixel (SRX).

5 Claims, 21 Drawing Sheets

(51) Int. Cl.
*G09G 3/34* (2006.01)
*G09G 5/00* (2006.01)

(52) U.S. Cl.
CPC ..... *G09G 3/3607* (2013.01); *G09G 3/3614* (2013.01); *G09G 3/3655* (2013.01); *G09G 5/005* (2013.01); *G09G 2300/0443* (2013.01); *G09G 2300/0452* (2013.01); *G09G 2300/0876* (2013.01); *G09G 2310/0205* (2013.01); *G09G 2320/0233* (2013.01); *G09G 2320/0247* (2013.01); *G09G 2340/0435* (2013.01); *G09G 2370/08* (2013.01)

(56) References Cited

U.S. PATENT DOCUMENTS

2009/0268110 A1 10/2009 Kitayama et al.
2010/0149227 A1 6/2010 Tomizawa et al.

* cited by examiner

LIQUID CRYSTAL DISPLAY DEVICE

TECHNICAL FIELD

The present invention relates to a liquid crystal display device.

BACKGROUND ART

In recent years, due to a rapid progress in high definition and high frequency of an image, the number of pixels in the vertical direction (number of scanning signal lines) has been increased also on the liquid crystal display device side which displays an image.

CITATION LIST

Patent Literature

PTL 1: International Publication No. WO 2006/093163

SUMMARY OF INVENTION

Technical Problem

Under the present circumstances, there is a problem in that it is difficult to mount a scanning signal line driving circuit due to an increase of the number of scanning signal lines, or charging of each pixel row (line extending in horizontal direction) becomes insufficient. An object of the present invention is to display a high quality input image on a liquid crystal panel of which the number of picture elements in a vertical direction is smaller than that of the input image.

Solution to Problem

In a liquid crystal display device, when displaying input image data in which pixel data of a first frame related to a first color pixel of an upper side picture element of two picture elements which are neighboring in a vertical direction is first pixel data, and pixel data of a second frame related to a first color pixel of a lower side picture element of the two picture elements is second pixel data, luminance of a first sub-pixel which is provided in a first color pixel of a predetermined picture element of a liquid crystal panel is higher than luminance of a second sub-pixel which is close to the first sub-pixel in a vertical direction in the first color pixel, and a sum total of luminance of the first and second sub-pixels corresponds to the first pixel data in a display period of the first frame, and a luminance of the second sub-pixel is higher than luminance of the first sub-pixel, and a sum total of luminance of the first and second sub-pixels corresponds to the second pixel data in a display period of the second frame.

Advantageous Effects of Invention

According to the configuration, it is possible to perform a high quality display of an input image on a liquid crystal panel of which the number of picture elements in the vertical direction is smaller than that of the input image.

DESCRIPTION OF EMBODIMENTS

Embodiments will be described as follows based on FIGS. 1 to 21. A liquid crystal display device LCD (refer to FIGS. 1, 16, and 19) includes a liquid crystal panel LCP, a display control circuit DCC, a source driver SD, a gate driver GD, a CS driver CSD, and a backlight BL. The backlight BL radiates light with respect to the liquid crystal panel LCP, the source driver SD drives a plurality of data signal lines of the liquid crystal panel LCP, the gate driver GD drives a plurality of scanning signal lines of the liquid crystal panel LCP, the CS driver CSD drives a plurality of holding capacitor wirings of the liquid crystal panel LCP, and the display control circuit DCC controls the source driver SD, the gate driver GD, and the CS driver CSD. In addition, the plurality of scanning signal lines are aligned in the vertical direction, and each scanning signal line is assumed to extend in the horizontal direction (row direction).

[First Embodiment]

Figure 1:
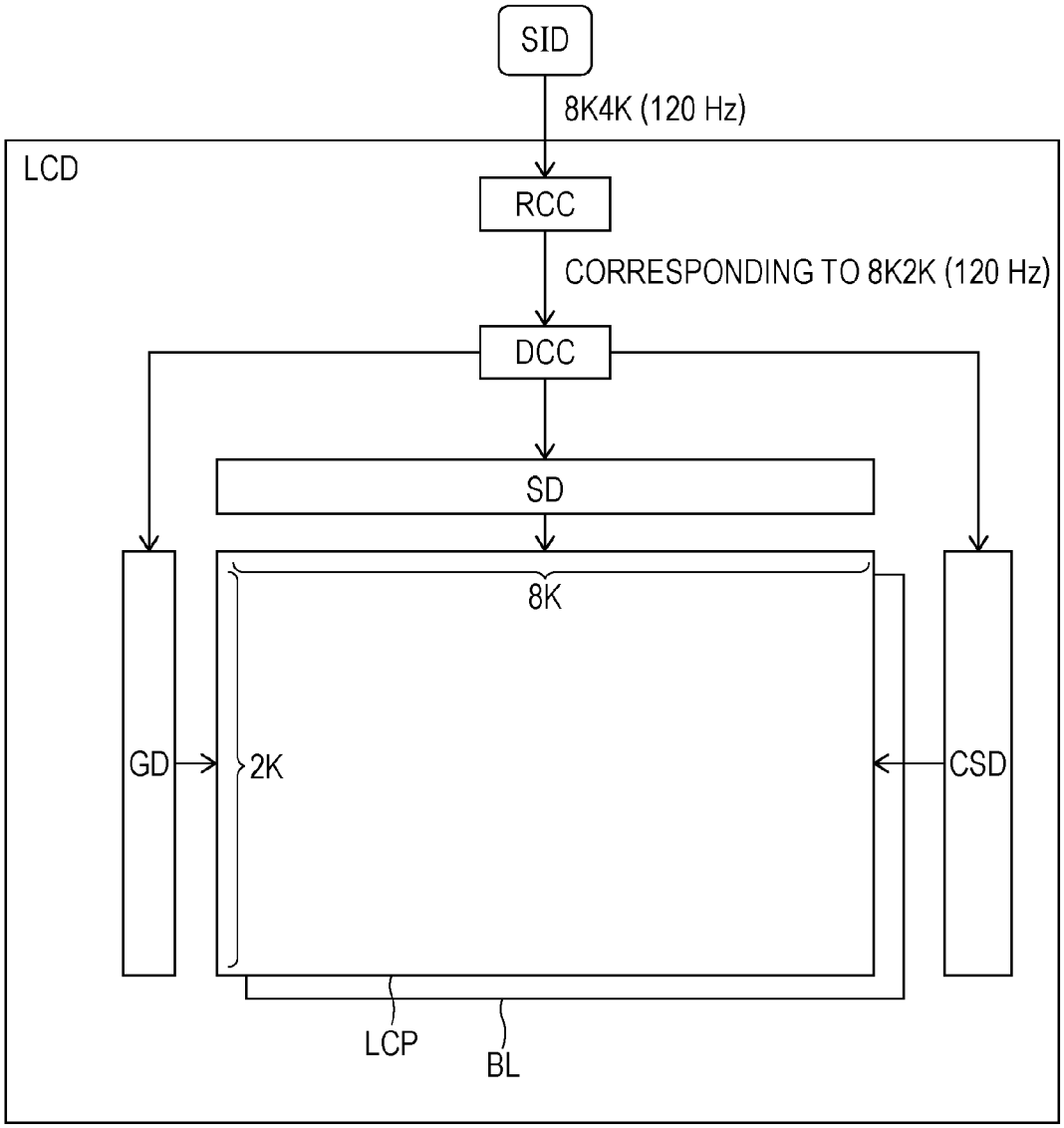
FIG. 1 is a block diagram which illustrates a configuration of a liquid crystal display device according to a first embodiment.

According to a first embodiment, as illustrated in FIG. 1, a case is described in which a resolution conversion circuit RCC is provided in a liquid crystal display device LCD, input image data SID is super hi-vision with a standard of Recommendation ITU-R BT.2020 (number of picture elements in horizontal direction is approximately 8000, number of picture elements in vertical direction is approximately 4000, and frequency is 120 Hz), the number of picture elements of a liquid crystal panel LCP in the horizontal direction is approximately 8000 (number of pixels is 24000), and the number of picture elements in the vertical direction is approximately 2000 (number of pixels is 2000). In addition, the picture element means a minimum unit of an image which is viewed from software, or a configuration on the liquid crystal panel side which displays a minimum unit of the image.

Figure 2:
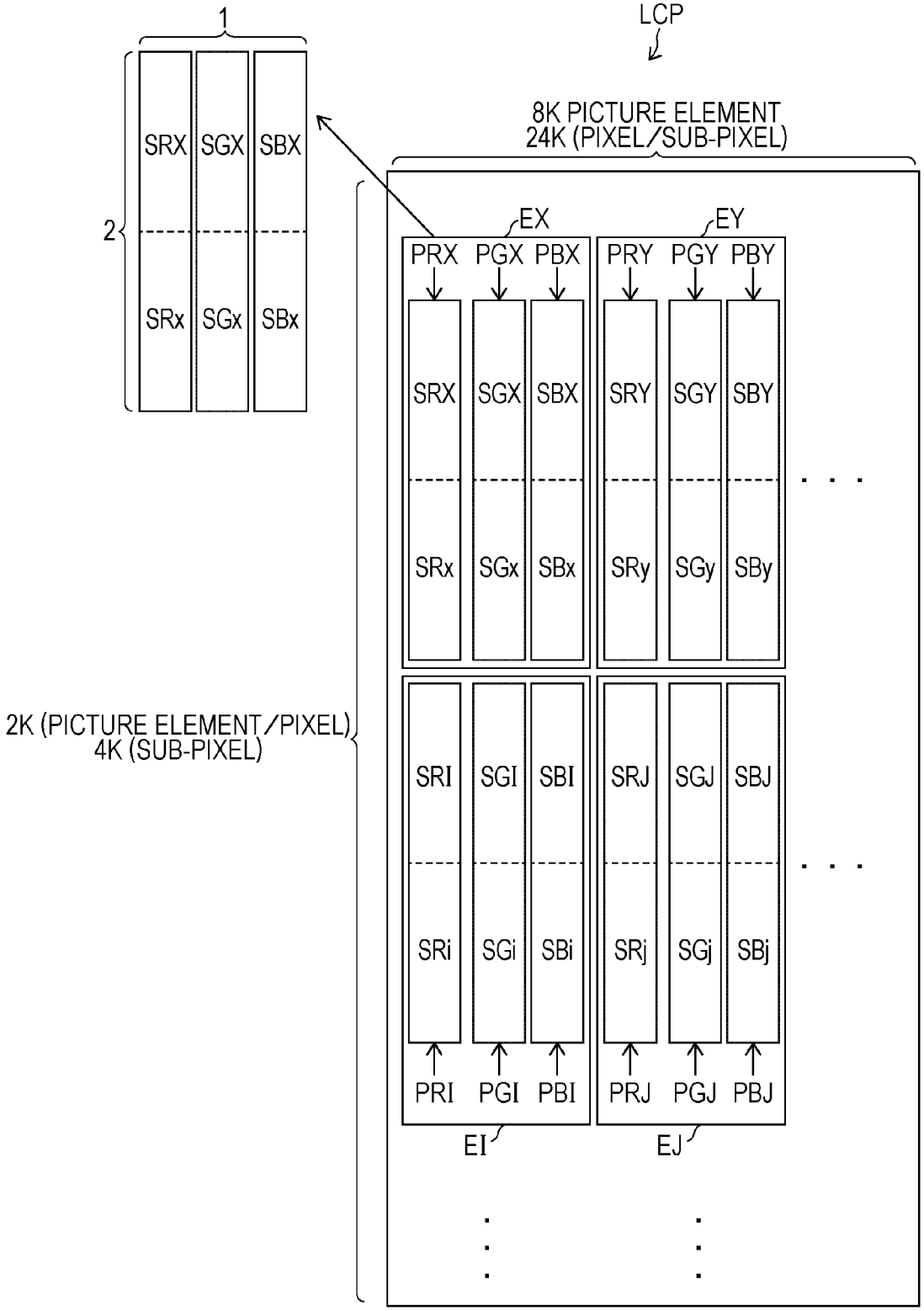
FIG. 2 is a block diagram which illustrates a picture element configuration of a liquid crystal panel according to the first embodiment.

As illustrated in FIG. 2, in the liquid crystal panel LCP, a picture element EX which is formed of a red pixel PRX, a green pixel PGX, and a blue picture element PBX which are aligned in the horizontal direction, and a picture element EY which is formed of a red pixel PRY, a green pixel PGY, and a blue picture element PBY which are aligned in the horizontal direction are adjoiningly aligned in the horizontal direction, a picture element EI which is formed of a red pixel PRI, a green pixel PGI, and a blue picture element PBI which are aligned in the horizontal direction, and a picture element EJ which is formed of a red pixel PRJ, a green pixel PGJ, and a blue picture element PBJ which are aligned in the horizontal direction are adjoiningly aligned in the horizontal direction, and the picture element EX and the picture element EI are close to each other in the vertical direction, and the picture element EY and the picture element EJ are close to each other in the vertical direction. In addition, an aspect ratio of each picture element (horizontal direction:vertical direction) is 1:2.

In addition, the pixel PRX is formed of a sub-pixel SRX and a sub-pixel SRx which are aligned in the vertical direction, the pixel PGX is formed of a sub-pixel SGX and a sub-pixel SGx which are aligned in the vertical direction, and the pixel PBX is formed of a sub-pixel SBX and a sub-pixel SBx which are aligned in the vertical direction. In addition, the pixel PRY is formed of a sub-pixel SRY and a sub-pixel SRy which are aligned in the vertical direction, the pixel PGY is formed of a sub-pixel SGY and a sub-pixel SGy which are aligned in the vertical direction, and the pixel PBY is formed of a sub-pixel SBY and a sub-pixel SBy which are aligned in the vertical direction. In addition, the pixel PRI is formed of a sub-pixel SRI and a sub-pixel SRi which are aligned in the vertical direction, the pixel PGI is formed of a sub-pixel SGI and a sub-pixel SGi which are aligned in the vertical direction, and the pixel PBI is formed of a sub-pixel SBI and a sub-pixel SBi which are aligned in the vertical direction. In addition, the pixel PRJ is formed of a sub-pixel SRJ and a sub-pixel SRj which are aligned in the vertical direction, the pixel PGJ is formed of a sub-pixel SGJ and a sub-pixel SGj which are aligned in the vertical direction, and the pixel PBJ is formed of a sub-pixel SBJ and a sub-pixel SBj which are aligned in the vertical direction.

Figure 3:
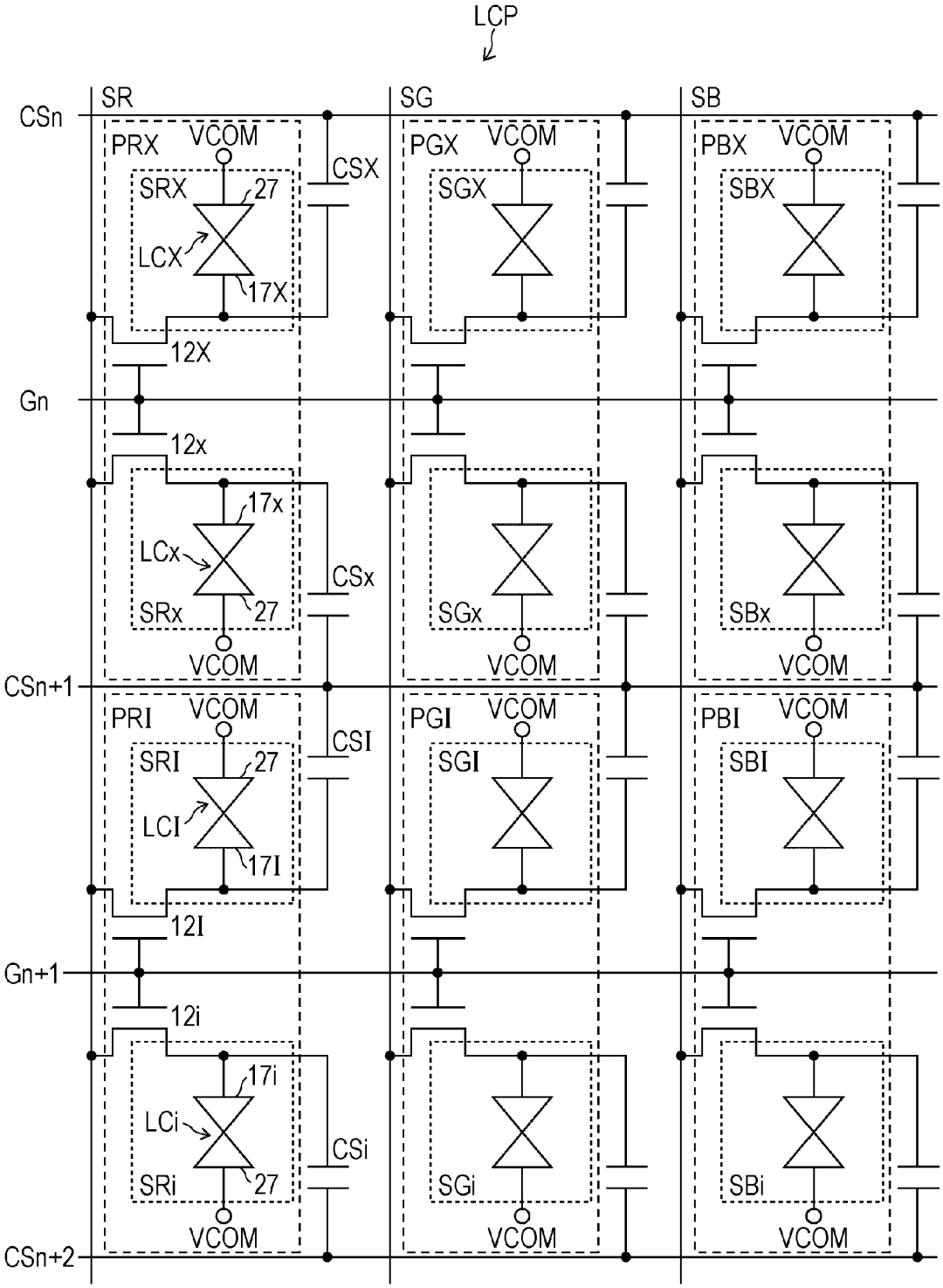
FIG. 3 is a circuit diagram which illustrates a pixel configuration of the liquid crystal panel according to the first embodiment.

FIG. 3 is a circuit diagram which illustrates configuration examples of the pixels PRX, PGX, and PBX. For example, the pixel PRX includes two pixel electrodes 17X and 17*x* which are aligned in the vertical direction, and the pixel PRI includes two pixel electrodes 17I and 17*i* which are aligned in the vertical direction. Here, the sub-pixel SRX includes a liquid crystal capacitor LCX which is formed of the pixel electrode 17X, a common electrode 27, and a liquid crystal layer which is interposed therebetween, the pixel electrode 17X is connected to the data signal line SR through a transistor 12X which is connected to a scanning signal line Gn, and the pixel electrode 17X forms the holding capacitor wiring CSn and a holding capacitor CSX. In addition, the sub-pixel SRx includes a liquid crystal capacitor LCx which is formed of the pixel electrode 17*x*, the common electrode 27, and a liquid crystal layer which is interposed therebetween, the pixel electrode 17*x* is connected to the data signal line SR through the transistor 12*x* which is connected to the scanning signal line Gn, and the pixel electrode 17*x* forms a holding capacitor wiring CSn+1 and the holding capacitor CSx. In addition, the sub-pixel SRI includes a liquid crystal capacitor LCI which is formed of a pixel electrode 17I, the common electrode 27, and a liquid crystal layer which is interposed therebetween. The pixel electrode 17I is connected to the data signal line SR through the transistor 12I which is connected to a scanning signal line Gn+1, and the pixel electrode 17I forms the holding capacitor wiring CSn+1 and a holding capacitor CSI. In addition, the sub-pixel SRi includes a liquid crystal capacitor LCi which is formed of a pixel electrode 17*i*, the common electrode 27, and a liquid crystal layer which is interposed therebetween. The pixel electrode 17*i* is connected to the data signal line SR through a transistor 12*i* which is connected to the scanning signal line Gn+1, and the pixel electrode 17*i* forms a holding capacitor wiring CSn+2 and a holding capacitor CSi.

Figure 4:
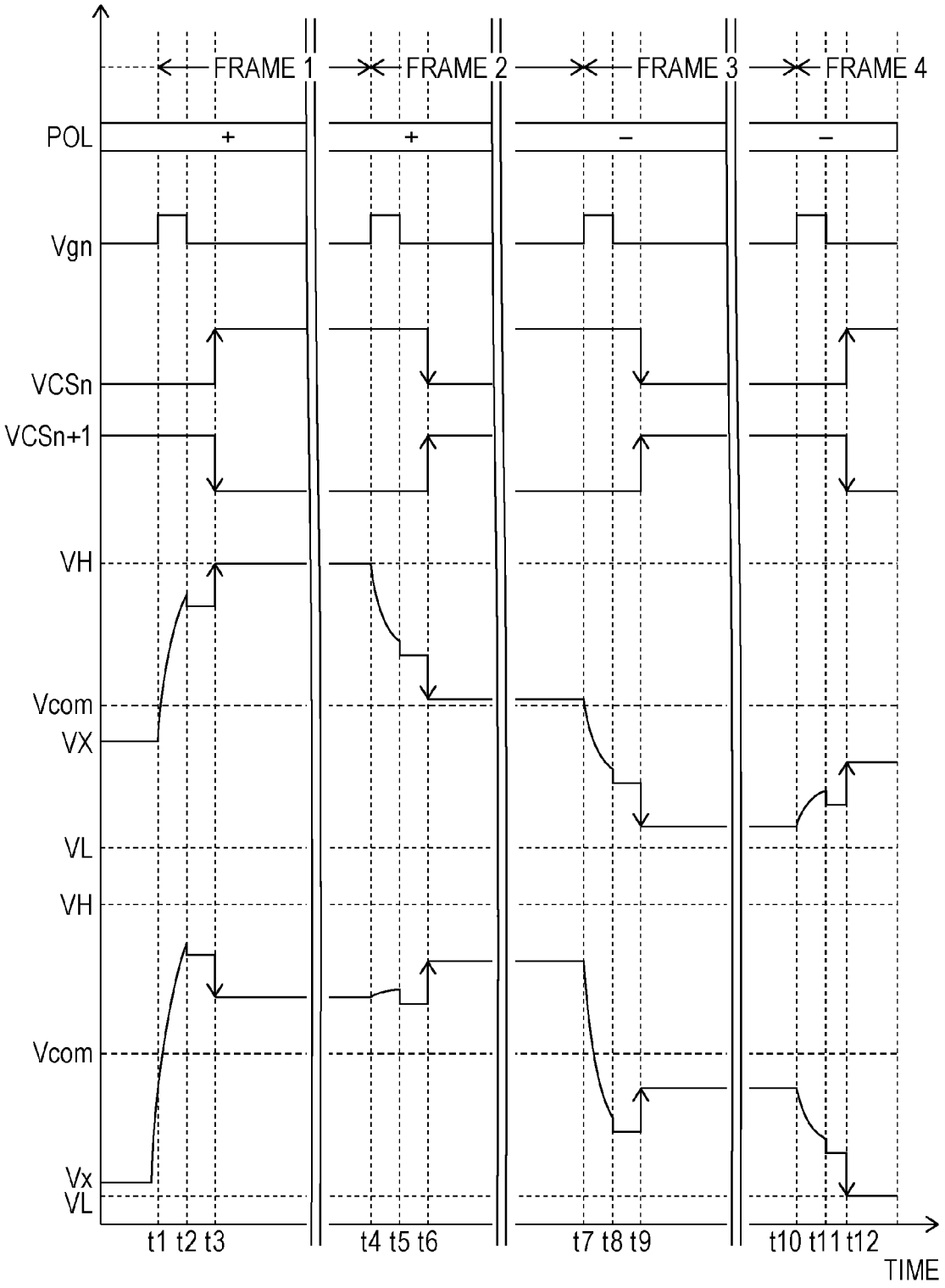
FIG. 4 is a timing chart which illustrates a driving method of the liquid crystal panel according to the first embodiment.

The data signal line SR, the scanning signal line Gn, and the holding capacitor wiring CSn and CSn+1 in FIG. 3 are driven as illustrated in FIG. 4. In addition, a potential of the scanning signal line Gn is set to Vgn, a polarity of a signal potential which is supplied from the data signal line SR is set to POL, a potential of the pixel electrode 17X is set to VX, a potential of the pixel electrode 17*x* is set to Vx, a potential of the holding capacitor wiring CSn is set to VCSn, a potential of the holding capacitor wiring CSn+1 is set to VCSn+1, a potential of the common electrode is set to Vcom, a positive side potential of a pixel electrode corresponding to a white display is set to VH, and a negative side potential of a pixel electrode corresponding to the white display is set to VL.

Figure 5:
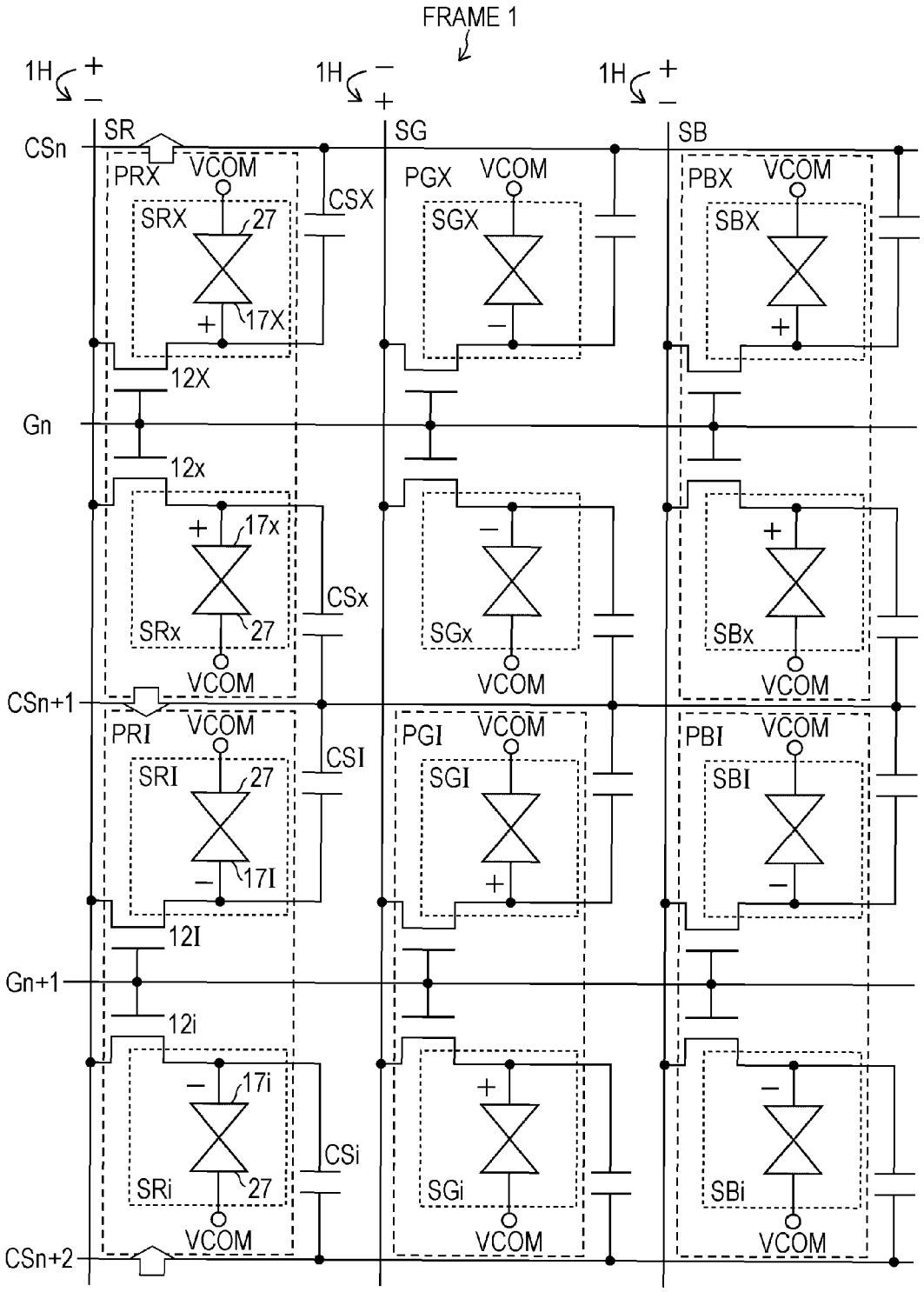
FIG. 5 is a schematic diagram which describes driving of frame 1 in FIG. 4.

In the frame 1 in FIG. 4, the same positive signal potential is written in the pixel electrodes 17X and 17*x* from the data signal line SR by selecting the scanning signal line Gn between t1 and t2, and the selection is ended in t2 (drawing in of potential occurs in pixel electrode). Thereafter, in t3, a positive signal potential of the pixel electrode 17X is pushed up, and a positive signal potential of the pixel electrode 17*x* is pushed down by pushing up the holding capacitor wiring CSn, and pushing down the holding capacitor wiring CSn+1. In this manner, as illustrated in FIG. 5, the sub-pixel SRX becomes a bright sub-pixel, and the sub-pixel SRx becomes a dark sub-pixel. In addition, in the frame 1, it is possible to obtain a display in which a bright sub-pixel and a dark sub-pixel are arranged in a checkered pattern as illustrated in FIG. 5, by reversing polarities of signal potentials of respective data signal lines SR, SG, and SB by 1H (horizontal scanning period), setting the polarities of signal potentials so as to be different between the data signal lines SR, SB and the data signal line SG in the same horizontal scanning period, and causing a potential phase of the holding capacitor wiring CSn to match with a potential phase of the holding capacitor wiring CSn+2.

Figure 6:
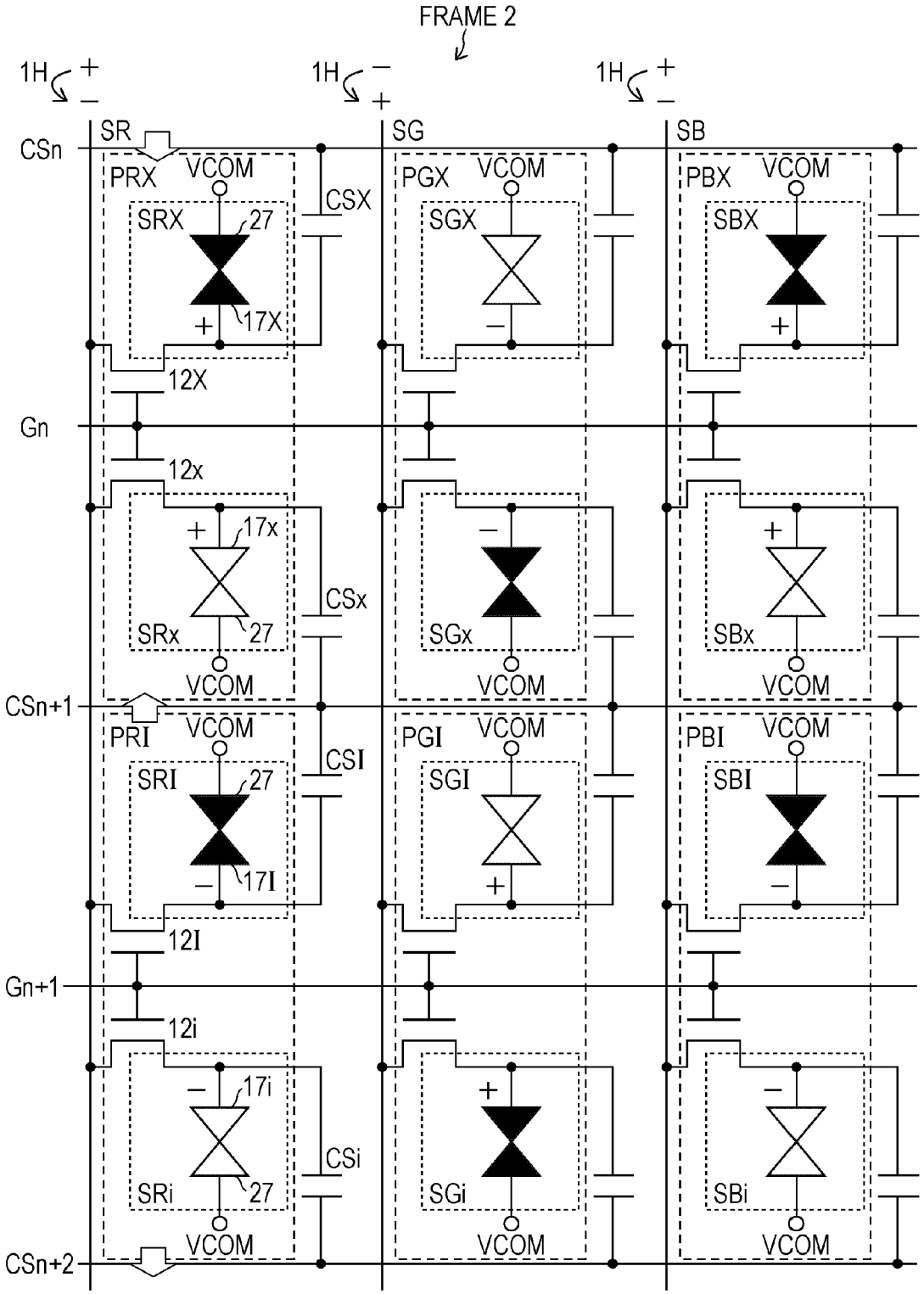
FIG. 6 is a schematic diagram which describes driving of frame 2 in FIG. 4.

In the frame 2 in FIG. 4, the same positive signal potential is written in the pixel electrodes 17X and 17*x* from the data signal line SR by selecting the scanning signal line Gn between t4 and t5, and the selection is ended in t5 (drawing in of potential occurs in each pixel electrode). Thereafter, a positive signal potential of the pixel electrode 17X is pushed down, and a positive signal potential of the pixel electrode 17*x* is pushed up by pushing down the holding capacitor wiring CSn, and pushing up the holding capacitor wiring CSn+1 in t6. In this manner, as illustrated in FIG. 6, the sub-pixel SRX becomes a dark sub-pixel, and the sub-pixel SRx becomes a bright sub-pixel. In addition, also in the frame 2, it is possible to obtain a display of a checkered pattern in which the bright sub-pixel and the dark sub-pixel are reversed from the frame 1 (FIG. 5) as illustrated in FIG. 6 by reversing polarities of signal potentials of respective data signal lines SR, SG, and SB by 1H (horizontal scanning period), setting the polarities of signal potentials so as to be different between the data signal lines SR, SB and the data signal line SG in the same horizontal scanning period, and causing a potential phase of the holding capacitor wiring CSn to match with a potential phase of the holding capacitor wiring CSn+2.

Figure 7:
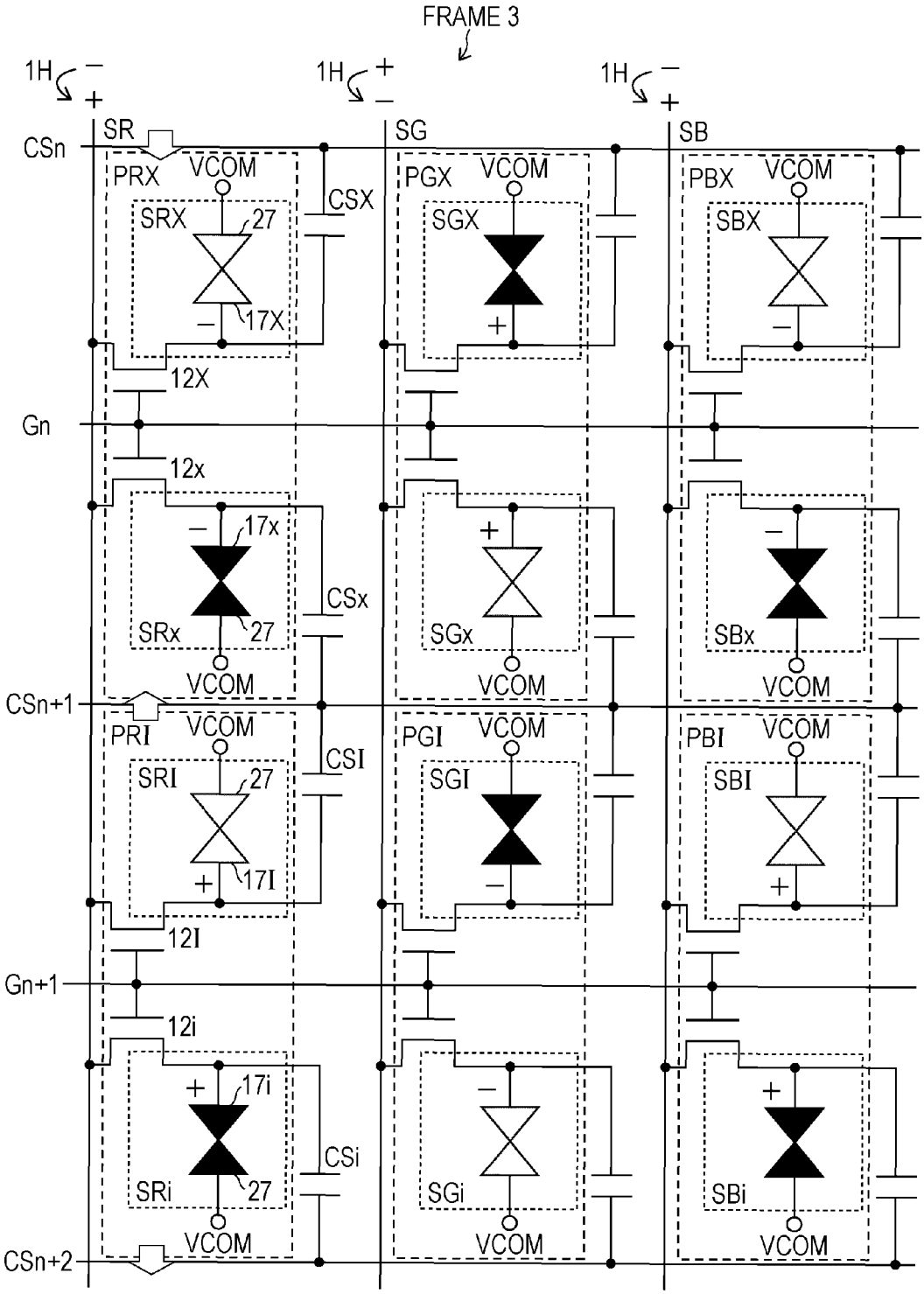
FIG. 7 is a schematic diagram which describes driving of frame 3 in FIG. 4.

In a frame 3 in FIG. 4, the same negative signal potential is written in the pixel electrodes 17X and 17*x* from the data signal line SR by selecting the scanning signal line Gn between t7 and t8, and the selection is ended in t8 (drawing in of potential occurs in each pixel electrode). Thereafter, a negative signal potential of the pixel electrode 17X is pushed down, and a negative signal potential of the pixel electrode 17*x* is pushed up by pushing down the holding capacitor wiring CSn, and pushing up the holding capacitor wiring CSn+1 in t9. In this manner, as illustrated in FIG. 7, the sub-pixel SRX becomes a bright sub-pixel, and the sub-pixel SRx becomes a dark sub-pixel. In addition, also in the frame 3, it is possible to obtain a display of a checkered pattern in which the bright sub-pixel and the dark sub-pixel are reversed from the frame 2 (FIG. 6) as illustrated in FIG. 7 by reversing polarities of signal potentials of respective data signal lines SR, SG, and SB by 1H (horizontal scanning period), setting the polarities of signal potentials so as to be different between the data signal lines SR, SB and the data signal line SG in the same horizontal scanning period, and causing a potential phase of the holding capacitor wiring CSn to match with a potential phase of the holding capacitor wiring CSn+2.

Figure 8:
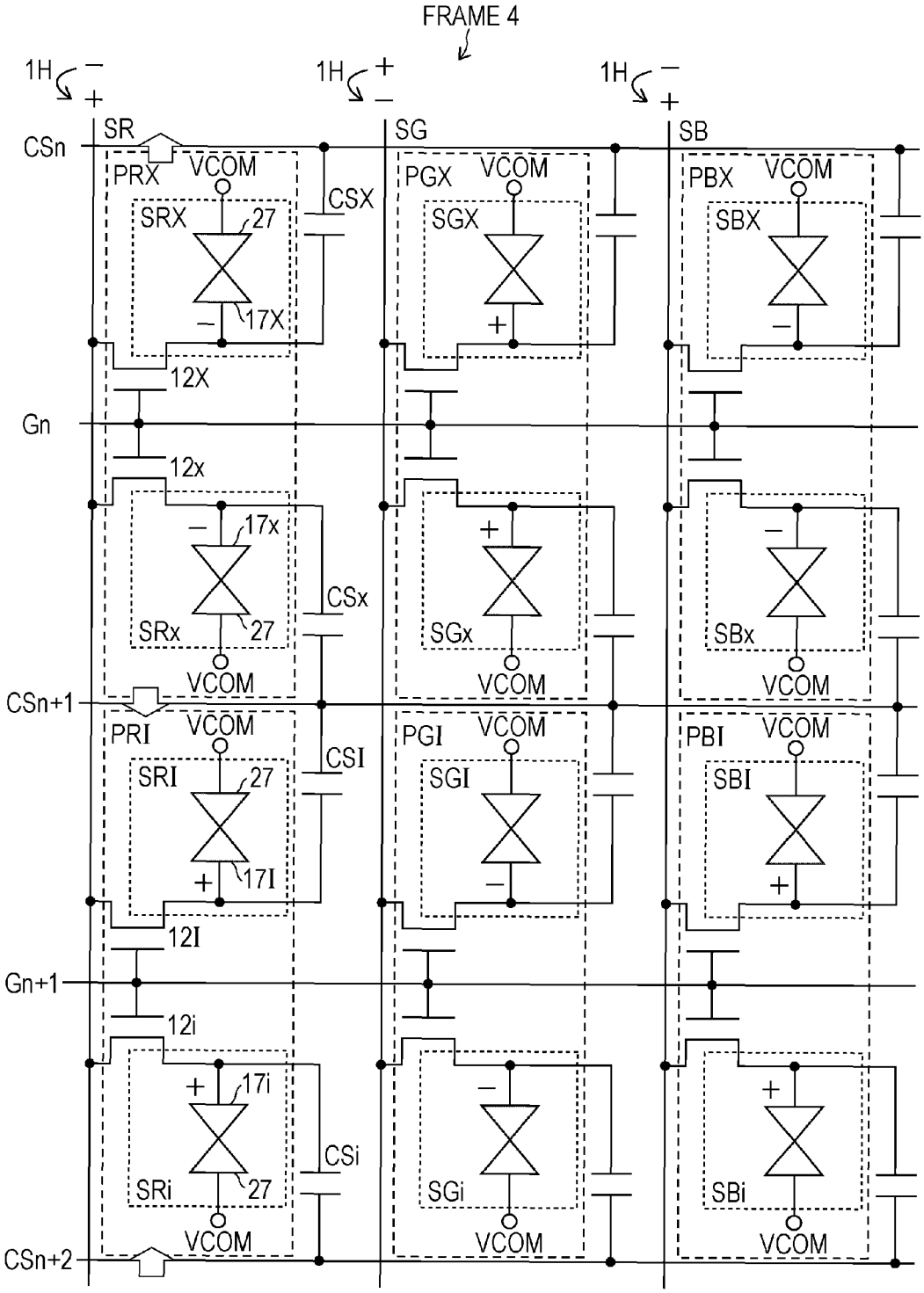
FIG. 8 is a schematic diagram which describes driving of frame 4 in FIG. 4.

In a frame 4 in FIG. 4, the same negative signal potential is written in the pixel electrodes 17X and 17*x* from the data signal line SR by selecting the scanning signal line Gn between t10 and t11, and the selection is ended in t11 (drawing in of potential occurs in each pixel electrode). Thereafter, a negative signal potential of the pixel electrode 17X is pushed up, and a negative signal potential of the pixel electrode 17*x* is pushed down by pushing up the holding capacitor wiring CSn, and pushing down the holding capacitor wiring CSn+1 in t12. In this manner, as illustrated in FIG. 8, the sub-pixel SRX becomes a dark sub-pixel, and the sub-pixel SRx becomes a bright sub-pixel. In addition, also in the frame 4, it is possible to obtain a display of a checkered pattern in which the bright sub-pixel and the dark sub-pixel are reversed from the frame 3 (FIG. 7) as illustrated in FIG. 8 by reversing polarities of signal potentials of respective data signal lines SR, SG, and SB by 1H (horizontal scanning period), setting the polarities of signal potentials so as to be different between the data signal lines SR, SB and the data signal line SG in the same horizontal scanning period, and causing a potential phase of the holding capacitor wiring CSn to match with a potential phase of the holding capacitor wiring CSn+2.

Figure 9:
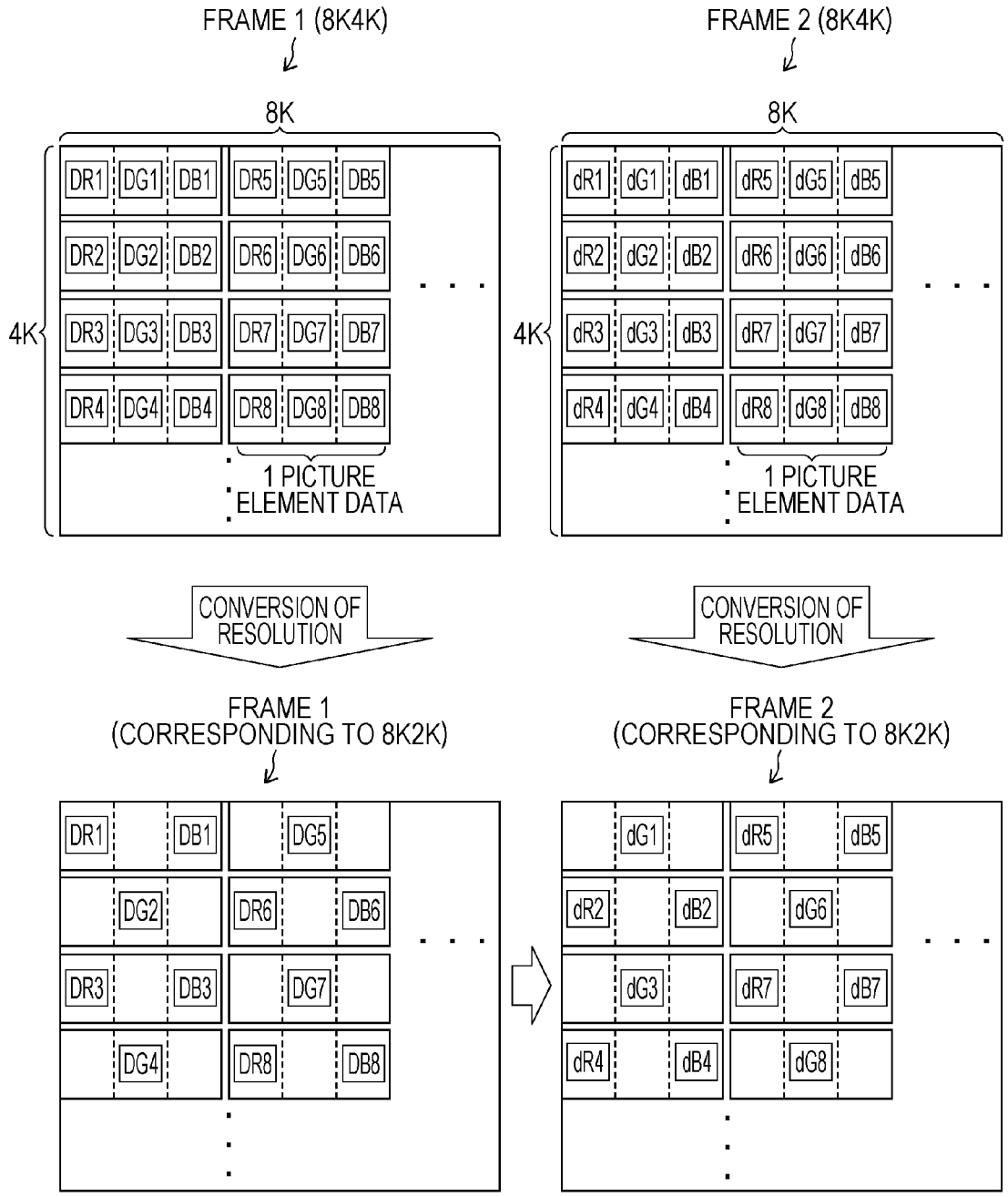
FIG. 9 is a schematic diagram which describes resolution conversions of frames 1 and 2.
Figure 10:
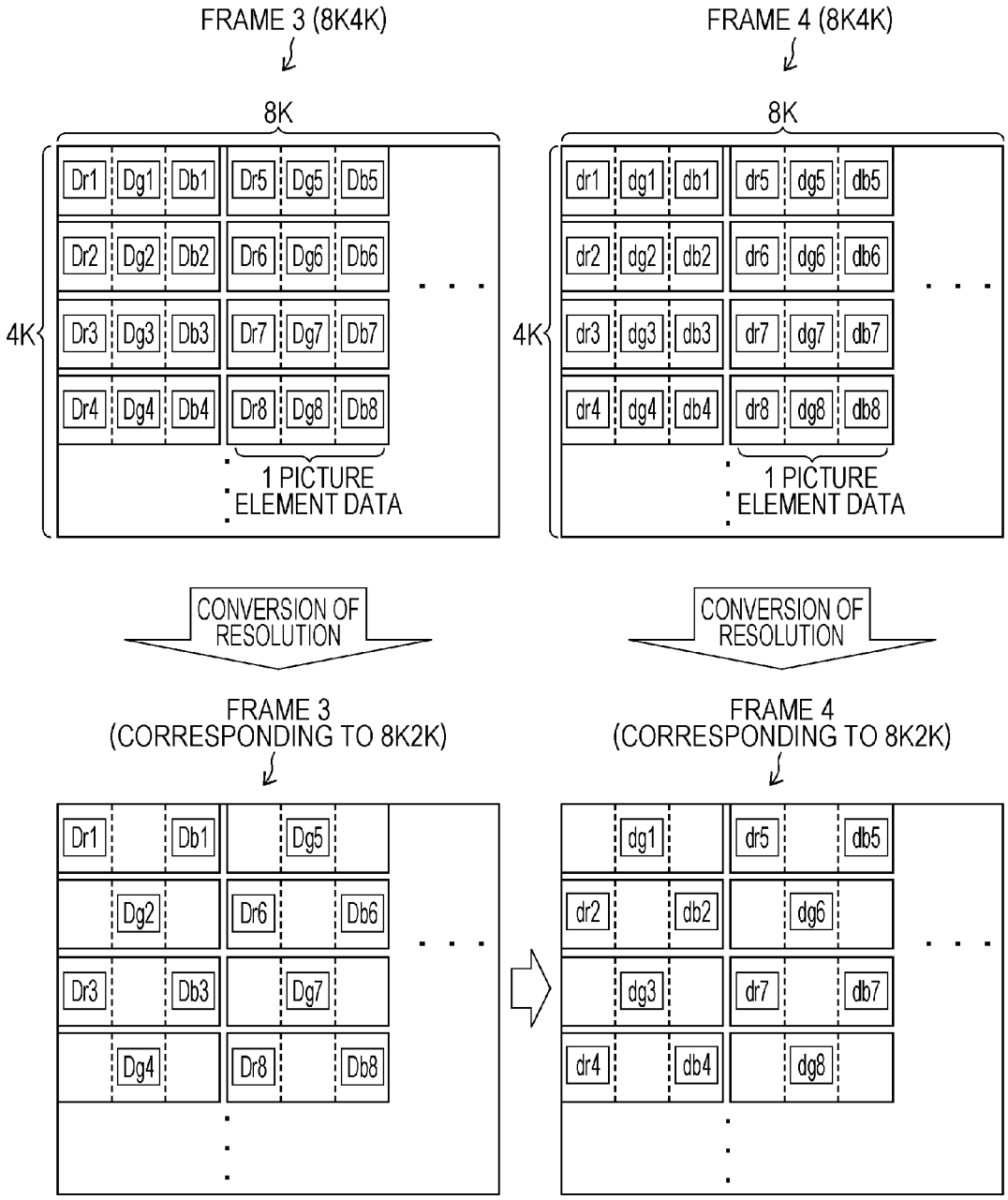
FIG. 10 is a schematic diagram which describes resolution conversions of frames 3 and 4.

The resolution conversion circuit RCC in FIG. 1 performs resolution conversion processes illustrated in FIGS. 9 and 10 with respect to the input image data SID, and outputs display data corresponding to 8K2K (120 Hz) to the display control circuit DCC.

For example, in the frame 1 (FIG. 9), when picture element data on the first row and first column is formed of three pixel data items of DR1 (red), DG1 (green), and DB1 (blue) which are aligned in the horizontal direction, picture element data on the second row and first column is formed of pixel data items of DR2 (red), DG2 (green), and DB2 (blue) which are aligned in the horizontal direction, picture element data on the third row and first column is formed of pixel data items of DR3 (red), DG3 (green), and DB3 (blue) which are aligned in the horizontal direction, and picture element data on the fourth row and first column is formed of pixel data items of DR4 (red), DG4 (green), and DB4 (blue) which are aligned in the horizontal direction, picture element data on the first row and second column is formed of three pixel data items of DR5 (red), DG5 (green), and DB5 (blue) which are aligned in the horizontal direction, picture element data on the second row and second column is formed of pixel data items of DR6 (red), DG6 (green), and DB6 (blue) which are aligned in the horizontal direction, picture element data on the third row and second column is formed of pixel data items of DR7 (red), DG7 (green), and DB7 (blue) which are aligned in the horizontal direction, and picture element data on the fourth row and second column is formed of pixel data items of DR8 (red), DG8 (green), and DB8 (blue) which are aligned in the horizontal direction with respect to eight picture element data items which are aligned in a matrix of 4 rows (extending in horizontal direction)×2 columns (extending in vertical direction), in the frame 1, twelve pixel data items (DR1, DR3, DG2, DG4, DB1, DB3, DR6, DR8, DG5, DG7, DB6, DB8) which are located in checkered patterns are selected from these twenty four pixel data items (four rows and six columns).

Meanwhile, in the frame 2 (FIG. 9), when picture element data on the first row and first column is formed of three pixel data items of dR1 (red), dG1 (green), and dB1 (blue) which are aligned in the horizontal direction, picture element data on the second row and first column is formed of pixel data items of dR2 (red), dG2 (green), and dB2 (blue) which are aligned in the horizontal direction, picture element data on the third row and first column is formed of pixel data items of dR3 (red), dG3 (green), and dB3 (blue) which are aligned in the horizontal direction, and picture element data on the fourth row and first column is formed of pixel data items of dR4 (red), dG4 (green), and dB4 (blue) which are aligned in the horizontal direction, picture element data on the first row and second column is formed of three pixel data items of dR5 (red), dG5 (green), and dB5 (blue) which are aligned in the horizontal direction, picture element data on the second row and second column is formed of pixel data items of dR6 (red), dG6 (green), and dB6 (blue) which are aligned in the horizontal direction, picture element data on the third row and second column is formed of pixel data items of dR7 (red), dG7 (green), and dB7 (blue) which are aligned in the horizontal direction, and picture element data on the fourth row and second column is formed of pixel data items of dR8 (red), dG8 (green), and dB8 (blue) which are aligned in the horizontal direction with respect to eight picture element data items which are aligned in a matrix of 4 rows (extending in horizontal direction)×2 columns (extending in vertical direction), in the frame 2, twelve pixel data items (dR2, dR4, dG1, dG3, dB2, dB4, dR5, dR7, dG6, dG8, dB5, dB7) at positions which are not selected in frame 1 (checkered patterns) are selected from these twenty-four pixel data items (four rows and six columns).

In addition, in the frame 3 (FIG. 10), when picture element data on the first row and first column is formed of three pixel data items of Dr1 (red), Dg1 (green), and Db1 (blue) which are aligned in the horizontal direction, picture element data on the second row and first column is formed of pixel data items of Dr2 (red), Dg2 (green), and Db2 (blue) which are aligned in the horizontal direction, picture element data on the third row and first column is formed of pixel data items of Dr3 (red), Dg3 (green), and Db3 (blue) which are aligned in the horizontal direction, and picture element data on the fourth row and first column is formed of pixel data items of Dr4 (red), Dg4 (green), and Db4 (blue) which are aligned in the horizontal direction, picture element data on the first row and second column is formed of three pixel data items of Dr5 (red), Dg5 (green), and Db5 (blue) which are aligned in the horizontal direction, picture element data on the second row and second column is formed of pixel data items of Dr6 (red), Dg6 (green), and Db6 (blue) which are aligned in the horizontal direction, picture element data on the third row and second column is formed of pixel data items of Dr7 (red), Dg7 (green), and Db7 (blue) which are aligned in the horizontal direction, and picture element data on the fourth row and second column is formed of pixel data items of Dr8 (red), Dg8 (green), and Db8 (blue) which are aligned in the horizontal direction with respect to eight picture element data items which are aligned in a matrix of 4 rows (extending in horizontal direction)×2 columns (extending in vertical direction), in the frame 3, twelve pixel data items (Dr1, Dr3, Dg2, Dg4, Db1, Db3, Dr6, Dr8, Dg5, Dg7, Db6, Db8) (checkered patterns) at positions which are selected in the frame 1 are selected from these twenty-four pixel data items (four rows and six columns).

Meanwhile, in the frame 4 (FIG. 10), when picture element data on the first row and first column is formed of three pixel data items of dr1 (red), dg1 (green), and db1 (blue) which are aligned in the horizontal direction, picture element data on the second row and first column is formed of pixel data items of dr2 (red), dg2 (green), and db2 (blue) which are aligned in the horizontal direction, picture element data on the third row and first column is formed of pixel data items of dr3 (red), dg3 (green), and db3 (blue) which are aligned in the horizontal direction, picture element data on the fourth row and first column is formed of pixel data items of dr4 (red), dg4 (green), and db4 (blue) which are aligned in the horizontal direction, picture element data on the first row and second column is formed of three pixel data items of dr5 (red), dg5 (green), and db5 (blue) which are aligned in the horizontal direction, picture element data on the second row and second column is formed of pixel data items of dr6 (red), dg6 (green), and db6 (blue) which are aligned in the horizontal direction, picture element data on the third row and second column is formed of pixel data items of dr7 (red), Dg7 (green), and db7 (blue) which are aligned in the horizontal direction, and picture element data on the fourth row and second column is formed of pixel data items of dr8 (red), dg8 (green), and db8 (blue) which are aligned in the horizontal direction with respect to eight picture element data items which are aligned in a matrix of 4 rows (extending in horizontal direction)×2 columns (extending in vertical direction), in the frame 4, twelve pixel data items (dr2, dr4, dg1, dg3, db2, db4, dr5, dr7, dg6, dg8, db5, db7) (checkered patterns) at positions which are not selected in the frame 3 are selected from these twenty-four pixel data items (four rows and six columns).

Figure 11:
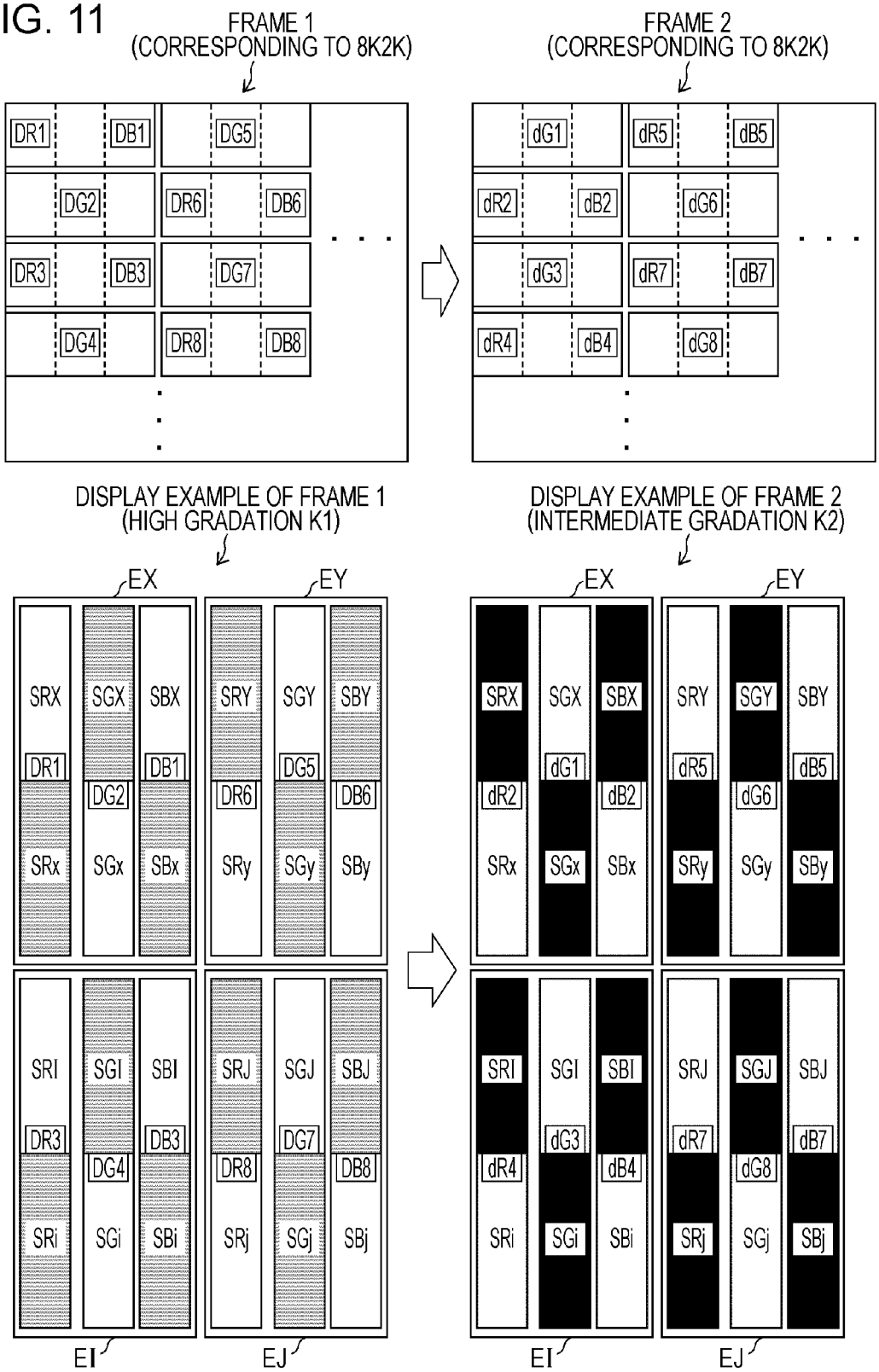
FIG. 11 is a schematic diagram which describes displays of the frames 1 and 2 according to the first embodiment.
Figure 12:
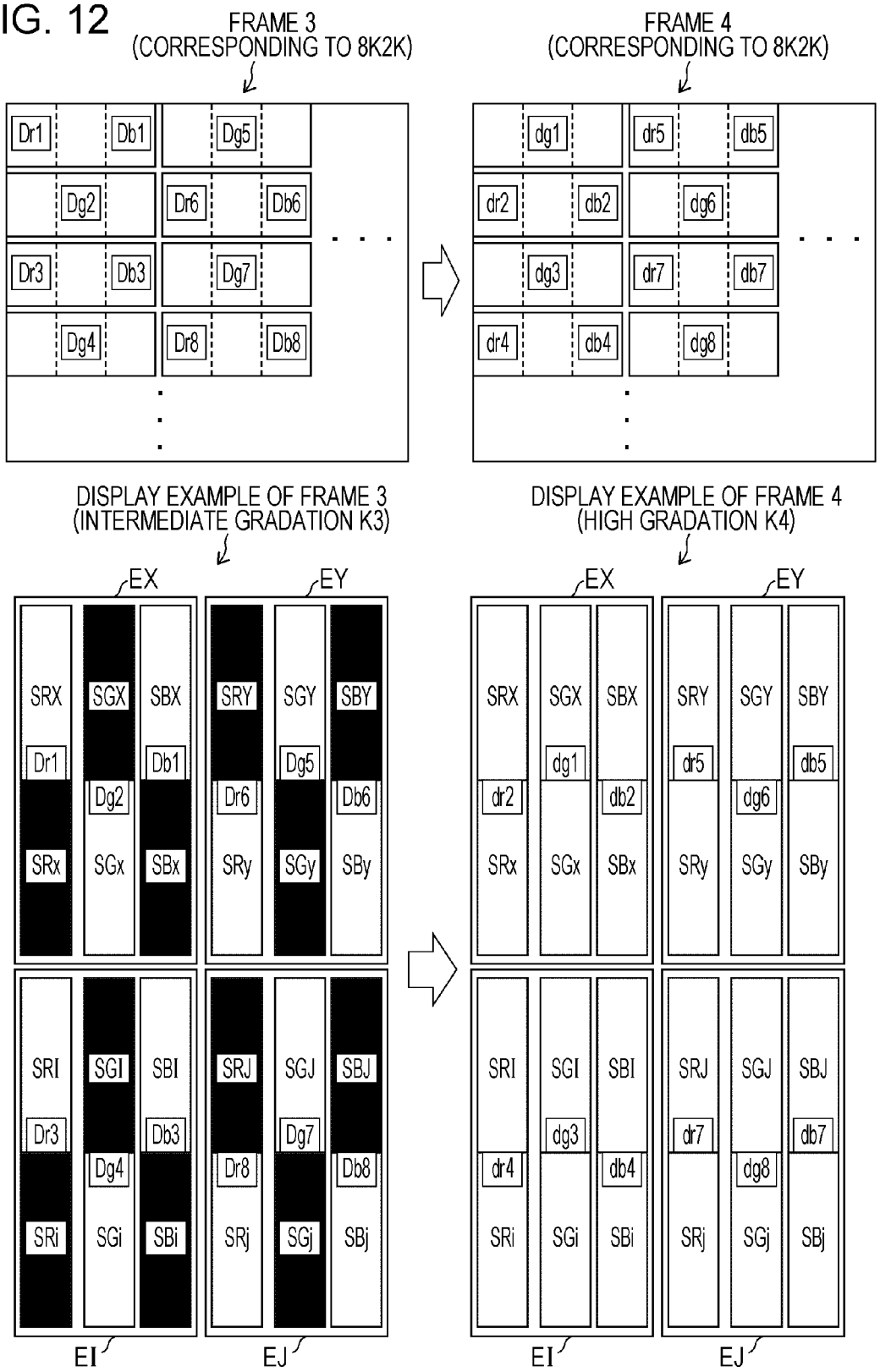
FIG. 12 is a schematic diagram which describes displays of the frames 3 and 4 according to the first embodiment.

In addition, display data corresponding to 8K2K (120 Hz) which is subjected to a resolution conversion process is displayed on the liquid crystal panel LCP as illustrated in FIGS. 11 and 12.

Figure 13:
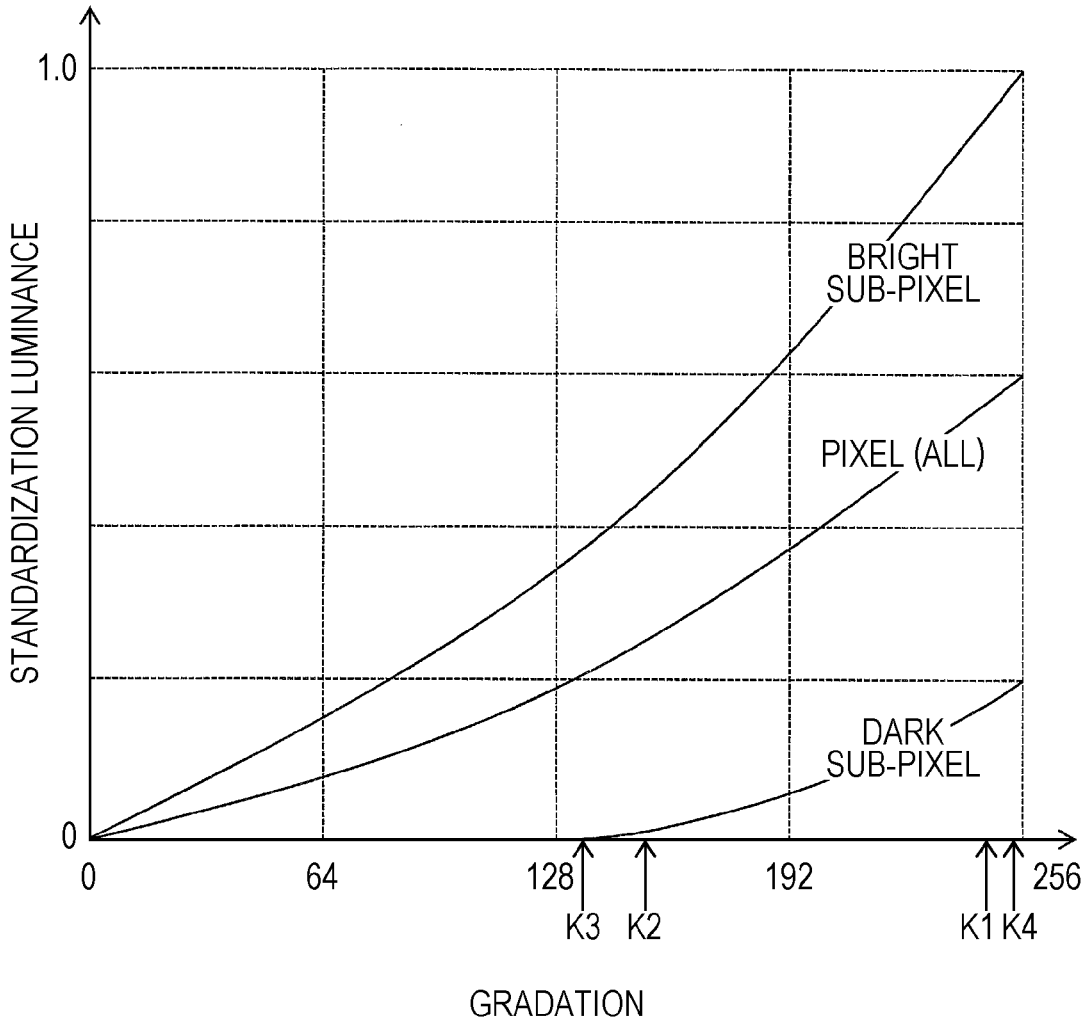
FIG. 13 is a graph which illustrates respective relationships in luminance between a bright sub-pixel, a dark sub-pixel, and all of pixels.

For example, in the picture elements EX and EI in the frame 1, a sum total of luminance of the sub-pixel SRX (bright sub-pixel) and the sub-pixel SRx (dark sub-pixel) is caused to correspond to the pixel data DR1 as illustrated in FIGS. 5 and 11. Here, respective relationships between a gradation of pixel data, standardization luminance of a bright sub-pixel, standardization luminance of a dark sub-pixel, and standardization luminance of all of pixels is illustrated in FIG. 13, and the standardization luminance of the dark sub-pixel is set to be 20% or less of the standardization luminance of the bright sub-pixel, regardless of the gradation of the pixel data. Since the gradation of the pixel data DR1 is high luminance K1 (refer to FIG. 13), standardization luminance of the sub-pixel SRX is close to 1.0 (white luminance), and standardization luminance of the sub-pixel SRx is close to 0.2 (20% of standardization luminance). In addition, as illustrated in FIGS. 5 and 11, a sum total of luminance of the sub-pixel SGX (dark sub-pixel) and the sub-pixel SGx (bright sub-pixel) is caused to correspond to the pixel data DG2, a sum total of luminance of the sub-pixel SBX (bright sub-pixel) and the sub-pixel SBx (dark sub-pixel) is caused to correspond to the pixel data DB1, a sum total of luminance of the sub-pixel SRI (bright sub-pixel) and the sub-pixel SRi (dark sub-pixel) is caused to correspond to the pixel data DR3, a sum total of luminance of the sub-pixel SGI (dark sub-pixel) and the sub-pixel SGi (bright sub-pixel) is caused to correspond to the pixel data DG4, and a sum total of luminance of the sub-pixel SBI (bright sub-pixel) and the sub-pixel SBi (dark sub-pixel) is caused to correspond to the pixel data DB3. Regarding the picture elements EY and EJ, they are illustrated in FIG. 11.

In addition, in the picture elements EX and EI in the frame 2, a sum total of luminance of the sub-pixel SRX (dark sub-pixel) and the sub-pixel SRx (bright sub-pixel) is caused to correspond to the pixel data dR2 as illustrated in FIGS. 6 and 11. Also in this case, standardization luminance of a dark sub-pixel is set to be 20% or less of standardization luminance of a bright sub-pixel. Since gradation of the pixel data dR2 is intermediate luminance K2 (refer to FIG. 13), standardization luminance of the sub-pixel SRX is close to 0 (black luminance), and standardization luminance of the sub-pixel SRx is higher than 0.2 (20% of standardization luminance). In addition, as illustrated in FIGS. 5 and 11, a sum total of luminance of the sub-pixel SGX (bright sub-pixel) and the sub-pixel SGx (dark sub-pixel) is caused to correspond to the pixel data dG1, a sum total of luminance of the sub-pixel SBX (dark sub-pixel) and the sub-pixel SBx (bright sub-pixel) is caused to correspond to the pixel data dB2, a sum total of luminance of the sub-pixel SRI (dark sub-pixel) and the sub-pixel SRi (bright sub-pixel) is caused to correspond to the pixel data dR4, a sum total of luminance of the sub-pixel SGI (bright sub-pixel) and the sub-pixel SGi (dark sub-pixel) is caused to correspond to the pixel data dG3, and a sum total of luminance of the sub-pixel SBI (dark sub-pixel) and the sub-pixel SBi (bright sub-pixel) is caused to correspond to the pixel data dB4. Regarding the picture elements EY and EJ, they are illustrated in FIG. 11.

In addition, in the picture elements EX and EI in the frame 3, a sum total of luminance of the sub-pixel SRX (bright sub-pixel) and the sub-pixel SRx (dark sub-pixel) is caused to correspond to the pixel data Dr1 as illustrated in FIGS. 7 and 12. Also in this case, standardization luminance of a dark sub-pixel is set to be 20% or less of standardization luminance of a bright sub-pixel. Since gradation of the pixel data Dr1 is intermediate luminance K3 (refer to FIG. 13), standardization luminance of the sub-pixel SRX is approximately 0.2 (20% of standardization luminance), and standardization luminance of the sub-pixel SRx is close to 0 (black luminance). In addition, as illustrated in FIGS. 7 and 12, a sum total of luminance of the sub-pixel SGX (dark sub-pixel) and the sub-pixel SGx (bright sub-pixel) is caused to correspond to the pixel data Dg2, a sum total of luminance of the sub-pixel SBX (bright sub-pixel) and the sub-pixel SBx (dark sub-pixel) is caused to correspond to the pixel data Db1, a sum total of luminance of the sub-pixel SRI (bright sub-pixel) and the sub-pixel SRi (dark sub-pixel) is caused to correspond to the pixel data Dr3, a sum total of luminance of the sub-pixel SGI (dark sub-pixel) and the sub-pixel SGi (bright sub-pixel) is caused to correspond to the pixel data Dg4, and a sum total of luminance of the sub-pixel SBI (bright sub-pixel) and the sub-pixel SBi (dark sub-pixel) is caused to correspond to the pixel data Db3. Regarding the picture elements EY and EJ, they are illustrated in FIG. 12.

In addition, in the picture elements EX and EI in the frame 4, a sum total of luminance of the sub-pixel SRX (dark sub-pixel) and the sub-pixel SRx (bright sub-pixel) is caused to correspond to the pixel data dr2 as illustrated in FIGS. 8 and 12. Also in this case, standardization luminance of a dark sub-pixel is set to be 20% or less of standardization luminance of a bright sub-pixel. Since gradation of the pixel data dr2 is high luminance K4 (refer to FIG. 13), standardization luminance of the sub-pixel SRX is approximately 0.2 (20% of standardization luminance), and standardization luminance of the sub-pixel SRx is approximately 1.0 (white luminance). In addition, as illustrated in FIGS. 8 and 12, a sum total of luminance of the sub-pixel SGX (bright sub-pixel) and the sub-pixel SGx (dark sub-pixel) is caused to correspond to the pixel data dg1, a sum total of luminance of the sub-pixel SBX (dark sub-pixel) and the sub-pixel SBx (bright sub-pixel) is caused to correspond to the pixel data db2, a sum total of luminance of the sub-pixel SRI (dark sub-pixel) and the sub-pixel SRi (bright sub-pixel) is caused to correspond to the pixel data dr4, a sum total of luminance of the sub-pixel SGI (bright sub-pixel) and the sub-pixel SGi (dark sub-pixel) is caused to correspond to the pixel data dg3, and a sum total of luminance of the sub-pixel SBI (dark sub-pixel) and the sub-pixel SBi (bright sub-pixel) is caused to correspond to the pixel data db4. Regarding the picture elements EY and EJ, they are illustrated in FIG. 12.

In this manner, in the liquid crystal display device LCD, when displaying input image data in which pixel data of the first frame related to a first color (red) pixel of an upper side picture element of two picture elements which are neighboring in a vertical direction is DR1, and pixel data of the second frame related to the first color (red) pixel of a lower side picture element of the two picture elements is dR2, a sum total of luminance of the sub-pixel SRX and the sub-pixel SRx is caused to correspond to the pixel data DR1 while setting luminance of the sub-pixel SRX which is provided in the first color (red) pixel PRX of a predetermined picture element EX to be higher than luminance of the sub-pixel SRx which is close to the sub-pixel SRX in the vertical direction in the pixel PRX, in the first frame period, and a sum total of luminance of the sub-pixel SRX and the sub-pixel SRx is caused to correspond to the pixel data dR2 while setting the luminance of the sub-pixel SRx to be higher than luminance of the sub-pixel SRX, in the second frame period.

According to the configuration, it is possible to perform a high quality display of input image data on a liquid crystal panel of which the number of picture elements in the vertical direction is a half of that of the input image data. In this manner, it is possible to improve the current situation in which mounting of a gate driver is difficult due to an increase of the number of scanning signal lines in a liquid crystal display device which displays an image with a high definition and high frequency (for example, super hi-vision with the number of pixels of 8K4K, and with refresh rate of 120 Hz), or charging of each pixel row (line extending in horizontal direction) is insufficient.

In addition, in a liquid crystal panel with a high resolution which is used in the embodiment, a double source structure (in this structure, two scanning signal lines are simultaneously selected in order to increase writing time) in which two data signal lines are provided in one pixel column which extends in the vertical direction is used in many cases; however, when the number of scanning lines can be reduced by half according to the embodiment, it is possible to return the reduced amount to a single source, and to reduce a cost due to the increase of the number of source drivers, or to reduce a mounting load due to high density.

According to the liquid crystal display device, in the second color (green) pixel PGX of the picture element EX, in the sub-pixel SGX and the sub-pixel SGx which are neighboring in the vertical direction, the sub-pixel SGX and the sub-pixel SRx are arranged so as to obliquely face each other, and the sub-pixel SGx and the sub-pixel SGX are arranged so as to obliquely face each other, and when displaying the above-described input image data of which pixel data of the first frame related to the second color (green) pixel of the lower side picture element of the two picture elements is DG2, and pixel data of the second frame related to the second color (green) pixel of the upper side picture element of the two picture elements is dG1, a sum total of luminance of the sub-pixel SGX and the sub-pixel SGx is caused to correspond to the pixel data DG2 while setting luminance of the sub-pixel SGx to be higher than luminance of the sub-pixel SGX in the first frame period, and a sum total of luminance of the sub-pixel SGX and the sub-pixel SGx is caused to correspond to the pixel data dG1 while setting luminance of the sub-pixel SGX to be higher than luminance of the sub-pixel SGx in the second frame period.

In addition, in the liquid crystal display device, in the first color (red) pixel of the picture element EY which is close to the picture element EX in the horizontal direction, the sub-pixel SRX and the sub-pixel SRY are arranged so as to be aligned in the horizontal direction, and the sub-pixel SRx and the sub-pixel SRy are arranged so as to be aligned in the horizontal direction in the sub-pixel SRY and the sub-pixel SRy which are neighboring in the vertical direction, and in the first frame period, luminance of the sub-pixel SRy is set to be higher than luminance of the sub-pixel SRY, and in the second frame period, luminance of the sub-pixel SRY is set to be higher than luminance of the sub-pixel SRy.

Figure 14:
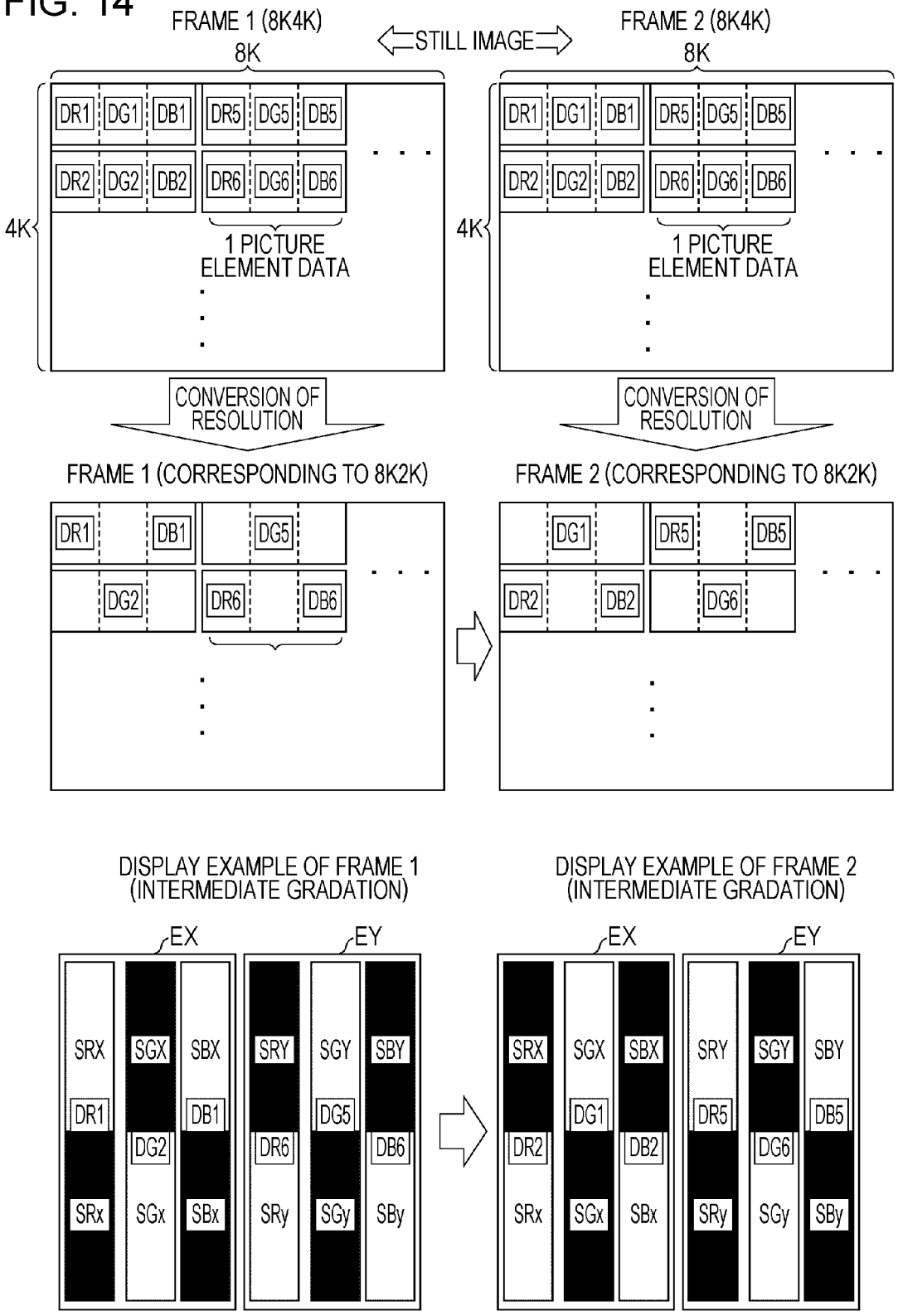
FIG. 14 is a schematic diagram which describes displaying of a still image portion.

According to the configuration, though a size of display data becomes a half (corresponding to 8K2K) of input image data (8K4K), since bright sub-pixels are distributed in a checkered pattern when displaying each frame, and bright sub-pixels of each color (bright sub-pixel of R, bright sub-pixel of G, and sub-pixel of B) are distributed in a checkered pattern even when bright sub-pixels are assorted by color, it is possible to obtain a sense of high definition (this is the same principle as that in which so-called dual green picture element structure generates sense of definition which exceeds actual number of picture elements) compared to an interlace (line thinning) display, for example. In particular, at a still image portion, it is possible to obtain a sense of definition which is comparable to a full size display (8K4K, 120 Hz) since mutual complementation is performed between continuous two frames, as illustrated in FIG. 14. With respect to a moving image portion, it is confirmed that there is no significant difference in a sense of definition compared to the full size display, since it is possible to suppress an occurrence of moving image blurring such as tailing even in the full size display, and to suppress moving image blurring caused by a display of each sub-pixel which is close to black in each one frame, in the above-described configuration (refer to FIGS. 11 and 12).

Figure 15:
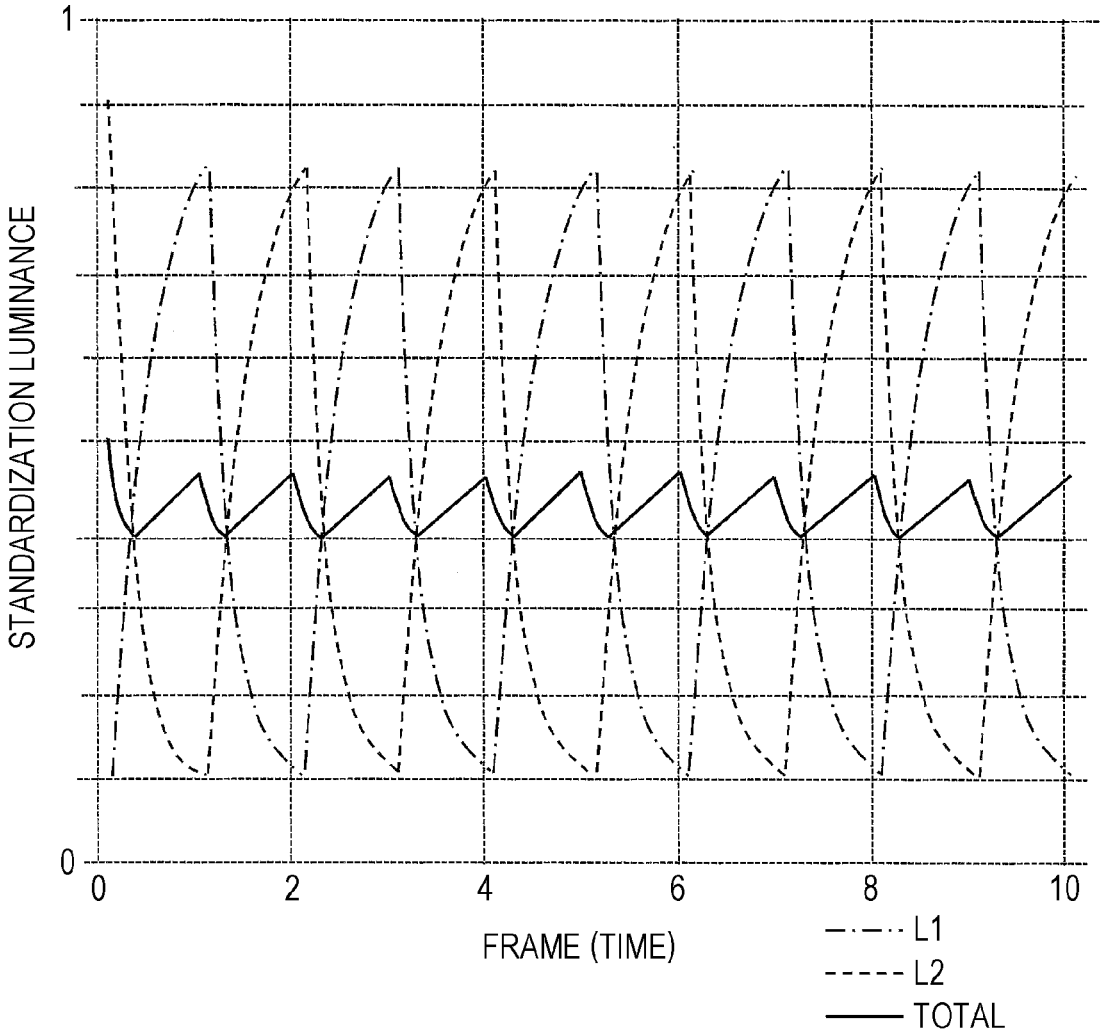
FIG. 15 is a graph which describes flicker in the first embodiment.

In addition, when displaying a high gradation (vicinity of white gradation, in particular), as illustrated in FIG. 15, luminance (L1 and L2) of two sub-pixel groups which are arranged in a checkered pattern (sub-pixel group which becomes bright sub-pixel in odd-numbered frame, and sub-pixel group which becomes bright sub-pixel in even-numbered frame) oscillate with a width of approximately 80%, respectively, and conspicuous flicker (one dot-dash line of L1 or dash line of L2) of 60 Hz occurs on only one side; however, in the above-described configuration (refer to FIGS. 11 and 12), since an oscillation phase between one sub-pixel group and the other sub-pixel group is deviated by a half cycle, in a total of two sub-pixel groups, amplitude becomes remarkably small as illustrated in FIG. 15 (solid line), and a cycle becomes 120 Hz, and as a result, it is understood that such a flicker is hardly visible.

[Second Embodiment]

Figure 16:
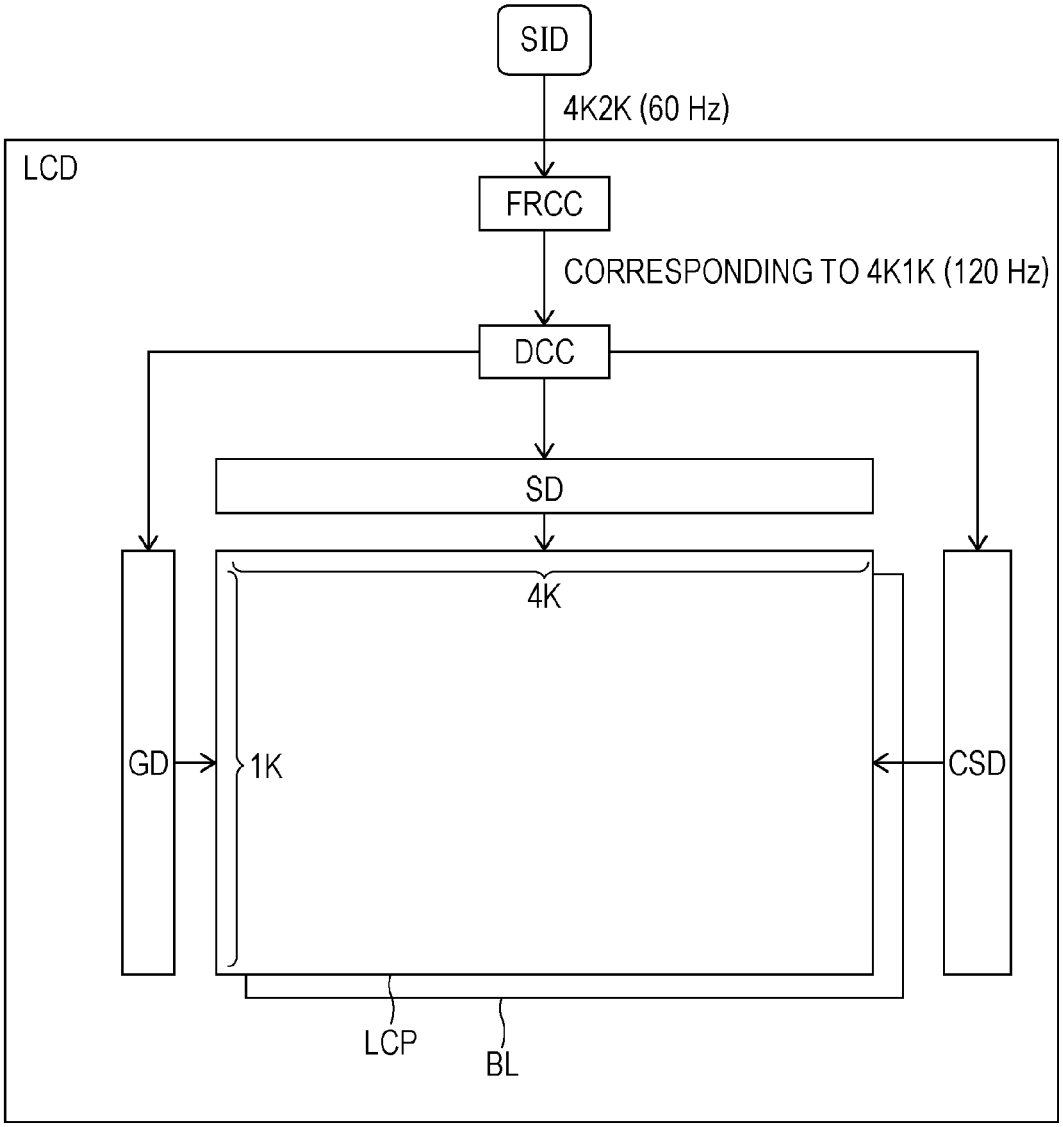
FIG. 16 is a block diagram which illustrates a configuration of a liquid crystal display device according to a second embodiment.

In a second embodiment, as illustrated in FIG. 16, a case in which a frame rate and resolution conversion circuit FRCC is provided in the liquid crystal display device LCD, the number of picture elements of a liquid crystal panel is 4K1K, the number of pixels of the input image data SID is 4K2K, and a frequency is 60 Hz will be described.

Figure 17:
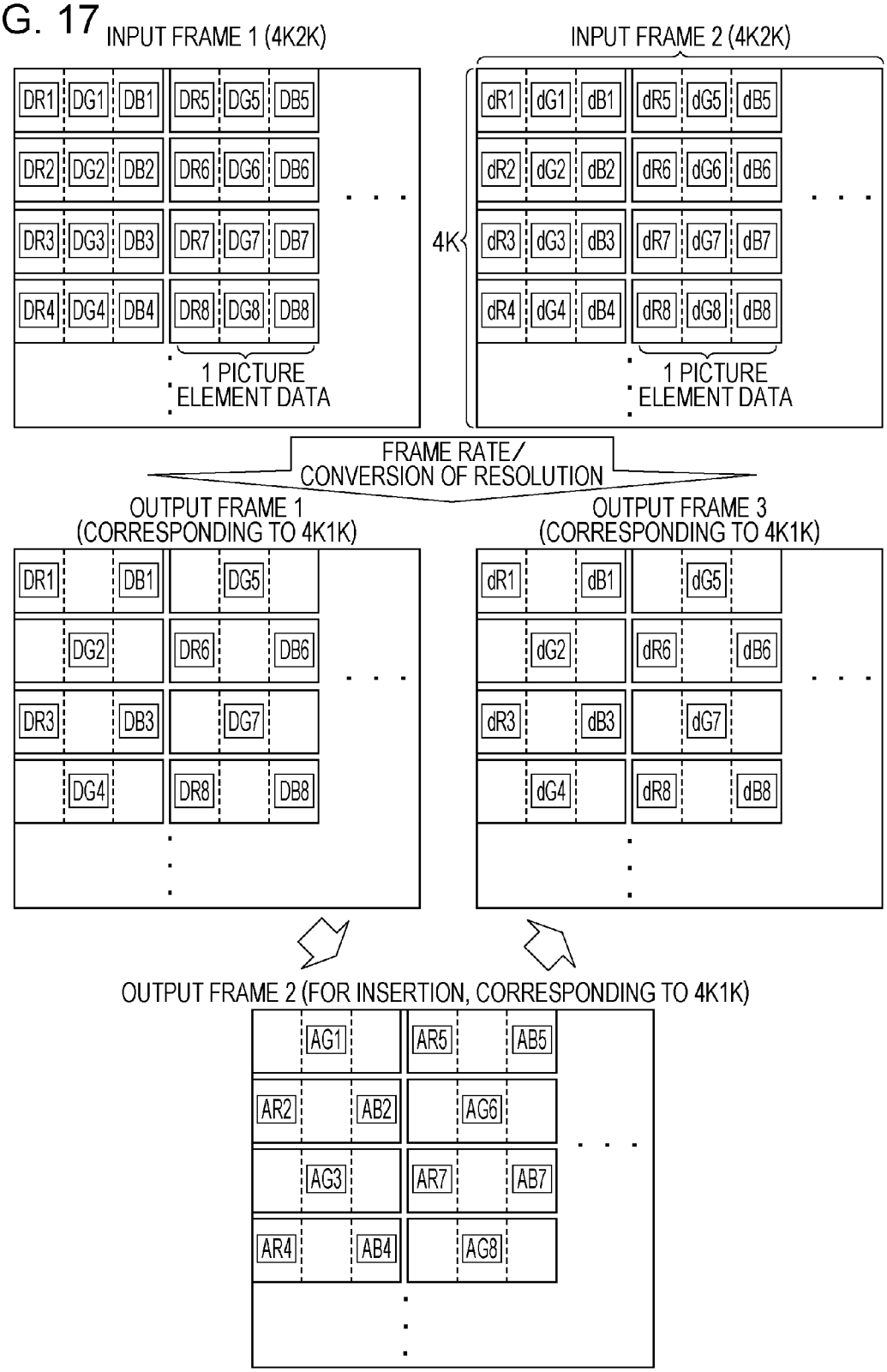
FIG. 17 is a schematic diagram which describes a frame rate and a resolution conversion according to the second embodiment.

The frame rate and resolution conversion circuit FRCC according to the second embodiment performs a frame rate and resolution conversion process which is illustrated in FIG. 17 with respect to the input image data SID, and outputs display data corresponding to 4K1K (120 Hz) to the display control circuit DCC.

For example, in an input frame 1 (FIG. 17), when picture element data on the first row and first column is formed of three pixel data of DR1 (red), DG1 (green), and DB1 (blue) which are aligned in the horizontal direction, picture element data on the second row and first column is formed of pixel data of DR2 (red), DG2 (green), and DB2 (blue) which are aligned in the horizontal direction, picture element data on the third row and first column is formed of pixel data of DR3 (red), DG3 (green), and DB3 (blue) which are aligned in the horizontal direction, picture element data on the fourth row and first column is formed of pixel data of DR4 (red), DG4 (green), and DB4 (blue) which are aligned in the horizontal direction, picture element data on the first row and second column is formed of three pixel data of DR5 (red), DG5 (green), and DB5 (blue) which are aligned in the horizontal direction, picture element data on the second row and second column is formed of pixel data of DR6 (red), DG6 (green), and DB6 (blue) which are aligned in the horizontal direction, picture element data on the third row and second column is formed of pixel data of DR7 (red), DG7 (green), and DB7 (blue) which are aligned in the horizontal direction, and picture element data on the fourth row and second column is formed of pixel data of DR8 (red), DG8 (green), and DB8 (blue) which are aligned in the horizontal direction, with respect to eight picture element data items which are aligned in a matrix of 4 rows×2 columns, twelve pixel data items (DR1, DR3, DG2, DG4, DB1, DB3, DR6, DR8, DG5, DG7, DB6, DB8) which are located in checkered patterns are selected from these twenty four (4 rows 6 columns) pixel data items in an output frame 1.

In addition, in the input frame 2 (FIG. 17), when picture element data on the first row and first column is formed of three pixel data of dR1 (red), dG1 (green), and dB1 (blue) which are aligned in the horizontal direction, picture element data on the second row and first column is formed of pixel data of dR2 (red), dG2 (green), and dB2 (blue) which are aligned in the horizontal direction, picture element data on the third row and first column is formed of pixel data of dR3 (red), dG3 (green), and dB3 (blue) which are aligned in the horizontal direction, picture element data on the fourth row and first column is formed of pixel data of dR4 (red), dG4 (green), and dB4 (blue) which are aligned in the horizontal direction, picture element data on the first row and second column is formed of three pixel data of dR5 (red), dG5 (green), and dB5 (blue) which are aligned in the horizontal direction, picture element data on the second row and second column is formed of pixel data of dR6 (red), dG6 (green), and dB6 (blue) which are aligned in the horizontal direction, picture element data on the third row and second column is formed of pixel data of dR7 (red), dG7 (green), and dB7 (blue) which are aligned in the horizontal direction, and picture element data on the fourth row and second column is formed of pixel data of dR8 (red), dG8 (green), and dB8 (blue) which are aligned in the horizontal direction, with respect to eight picture element data items which are aligned in a matrix of 4 rows×2 columns, pixel data AG1 is generated from pixel data DG1 and dG1, pixel data AR2 is generated from pixel data DR2 and dR2, pixel data AB2 is generated from pixel data DB2 and dB2, pixel data AG3 is generated from pixel data DG3 and dG3, pixel data AR4 is generated from pixel data DR4 and dR4, pixel data AB4 is generated from pixel data DB4 and db4, and similarly, pixel data AR5, AB5, AG6, AR7, AB7, and AG8 are generated, and these twelve pixel data items which are located in a checkered pattern are used in an output frame 2 which is for insertion.

In addition, in an output frame 3, twelve pixel data items (dR1, dR3, dG2, dG4, dB1, dB3, dR6, dR8, dG5, dG7, dB6, dB8) at positions which are selected in the output frame 1 (checkered pattern) are selected from twenty-four (four rows and six columns) pixel data items of the input frame 2.

Figure 18:
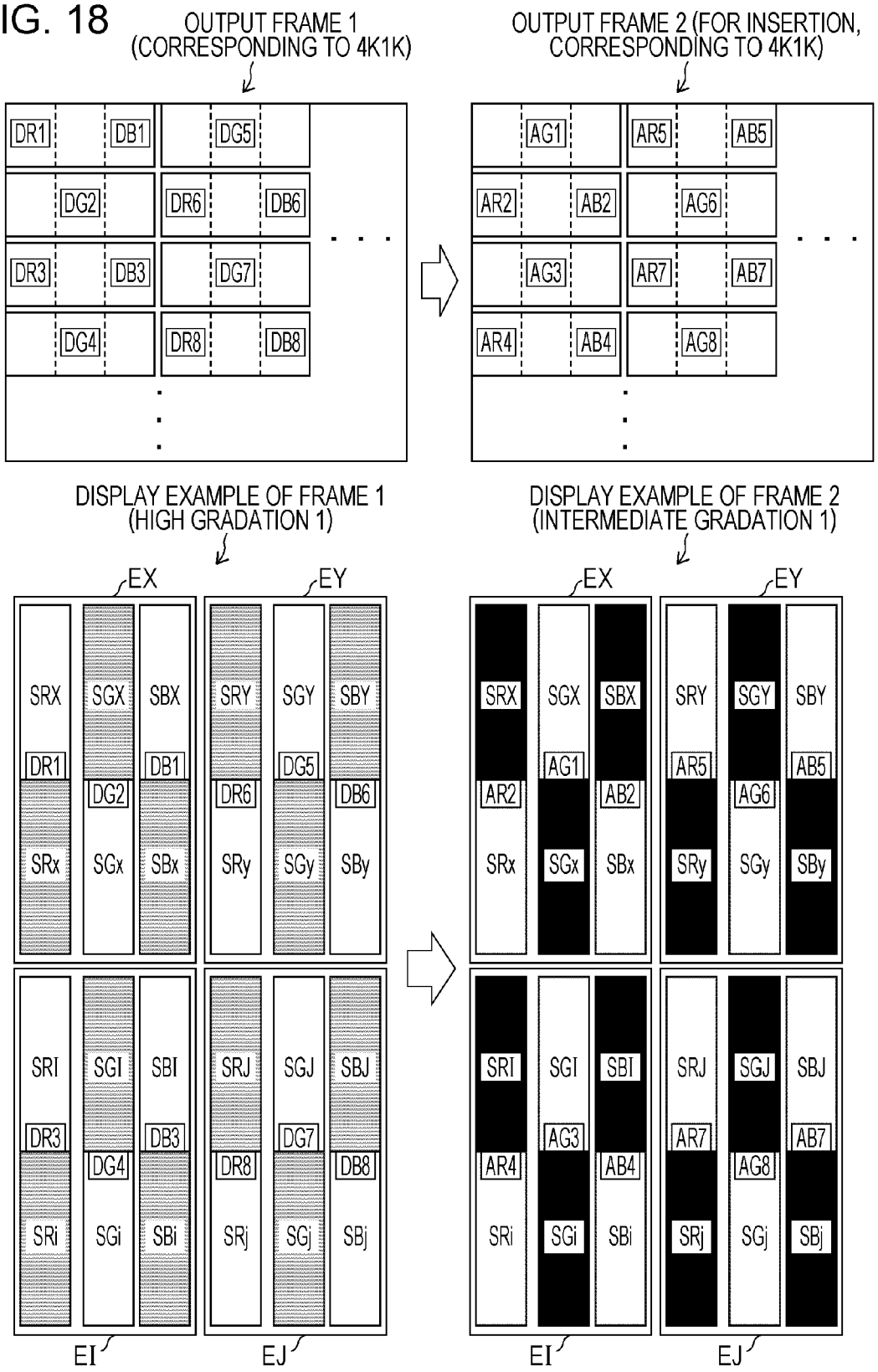
FIG. 18 is a schematic diagram which describes displaying of frames 1 and 2 according to the second embodiment.

In addition, display examples of the output frame 1 and the output frame 2 (for insertion) in the second embodiment are illustrated in FIG. 18.

[Third Embodiment]

Figure 19:
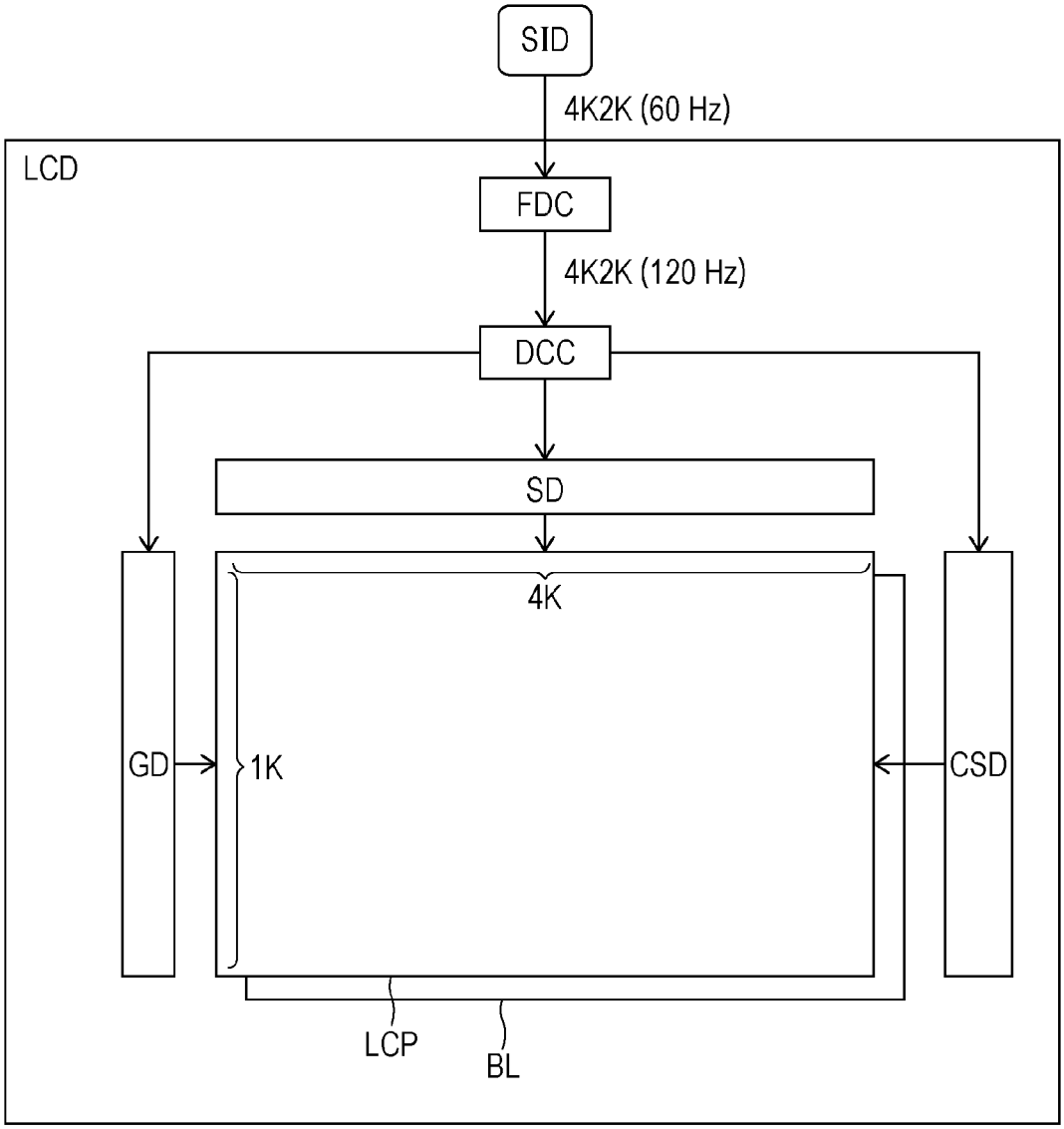
FIG. 19 is a block diagram which illustrates a configuration of a liquid crystal display device according to a third embodiment.

In a third embodiment, as illustrated in FIG. 19, a case in which a frame division circuit FDC is provided in the liquid crystal display device LCD, the number of picture elements of a liquid crystal panel is 4K1K, the number of pixels of the input image data SID is 4K2K, and a frequency is 60 Hz will be described. In addition, an aspect ratio (horizontal direction:vertical direction) of each picture element of the liquid crystal panel is 1:2.

Figure 20:
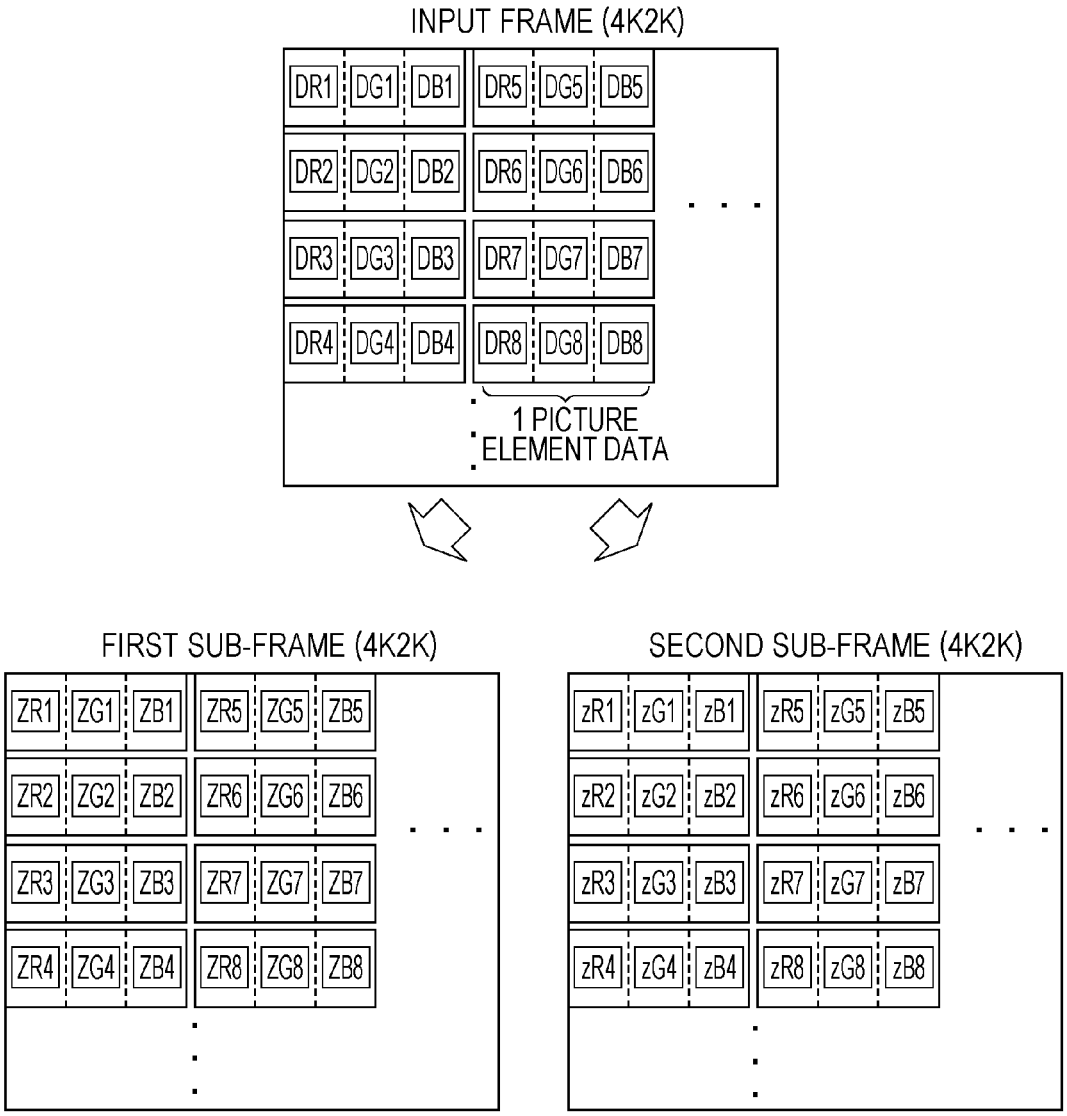
FIG. 20 is a schematic diagram which describes a frame division according to the third embodiment.

The frame division circuit FDC according to the third embodiment performs a frame division process which is illustrated in FIG. 20 with respect to the input image data SID, and outputs display data corresponding to 4K2K (120 Hz) to the display control circuit DCC.

For example, in one input frame (4K2K) which is illustrated in FIG. 20, when picture element data on the first row and first column is formed of three pixel data of DR1 (red), DG1 (green), and DB1 (blue) which are aligned in the horizontal direction, picture element data on the second row and first column is formed of pixel data of DR2 (red), DG2 (green), and DB2 (blue) which are aligned in the horizontal direction, picture element data on the third row and first column is formed of pixel data of DR3 (red), DG3 (green), and DB3 (blue) which are aligned in the horizontal direction, picture element data on the fourth row and first column is formed of pixel data of DR4 (red), DG4 (green), and DB4 (blue) which are aligned in the horizontal direction, picture element data on the first row and second column is formed of three pixel data of DR5 (red), DG5 (green), and DB5 (blue) which are aligned in the horizontal direction, picture element data on the second row and second column is formed of pixel data of DR6 (red), DG6 (green), and DB6 (blue) which are aligned in the horizontal direction, picture element data on the third row and second column is formed of pixel data of DR7 (red), DG7 (green), and DB7 (blue) which are aligned in the horizontal direction, and picture element data on the fourth row and second column is formed of pixel data of DR8 (red), DG8 (green), and DB8 (blue) which are aligned in the horizontal direction with respect to eight picture element data items which are aligned in a matrix of 4 rows×2 columns, twenty-four (four rows and six columns) pixel data items for a first sub-frame, and twenty-four (four rows and six columns) pixel data items for a second sub-frame which correspond to these twenty-four (four rows and six columns) pixel data items, respectively, are generated.

For example, pixel data ZR1 for the first sub-frame, and pixel data zR1 for the second sub-frame are generated with respect to the pixel data DR1, pixel data ZR2 for the first sub-frame, and pixel data zR2 for the second sub-frame are generated with respect to the pixel data DR2, pixel data ZR3 for the first sub-frame, and pixel data zR3 for the second sub-frame are generated with respect to the pixel data DR3, and pixel data ZR4 for the first sub-frame, and pixel data zR4 for the second sub-frame are generated with respect to the pixel data DR4. The same applies to the pixel data items DG1 to DG4 or pixel data items DB1 to DB4.

Figure 21:
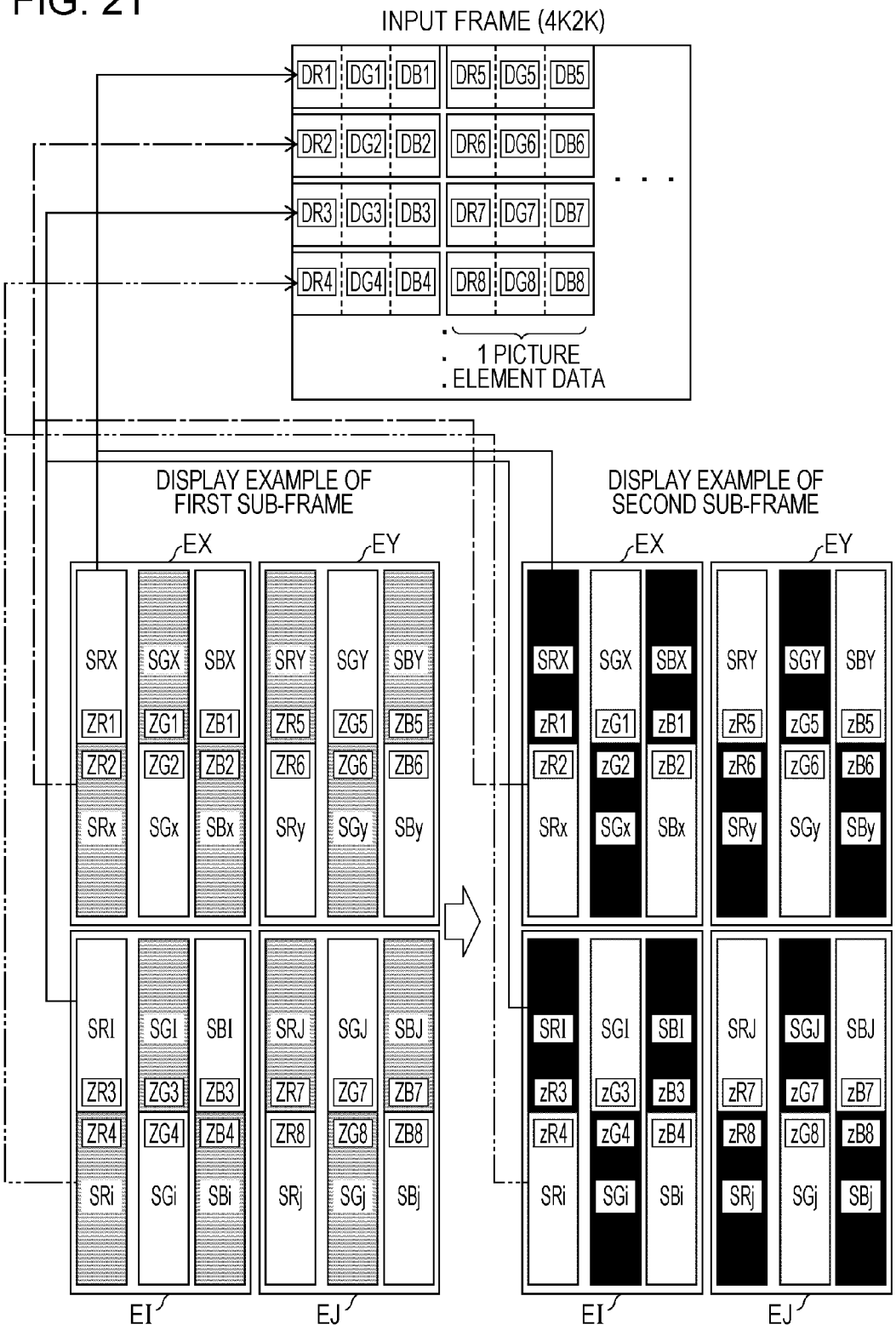
FIG. 21 is a schematic diagram which describes displaying of one input frame (first and second sub-frames) according to the third embodiment.

Display data of 4K2K (120 Hz) which is subjected to a frame division process as illustrated in FIG. 20 is displayed on the liquid crystal panel LCP as illustrated in FIG. 21.

For example, as illustrated in FIG. 21, in the picture element EX, a sum total of luminance of the sub-pixel SRX of the first sub-frame (high luminance corresponding to pixel data ZR1) and luminance of the sub-pixel SRX of the second sub-frame (low luminance corresponding to pixel data zR1) is caused to correspond to the pixel data DR1, a sum total of luminance of the sub-pixel SGX of the first sub-frame (low luminance corresponding to pixel data ZG1) and luminance of the sub-pixel SGX of the second sub-frame (high luminance corresponding to pixel data zG1) is caused to correspond to the pixel data DG1, a sum total of luminance of the sub-pixel SBX of the first sub-frame (high luminance corresponding to pixel data ZB1) and luminance of the sub-pixel SBX of the second sub-frame (low luminance corresponding to pixel data zB1) is caused to correspond to the pixel data DB1, a sum total of luminance of the sub-pixel SRx of the first sub-frame (low luminance corresponding to pixel data ZR2) and luminance of sub-pixel SRx of the second sub-frame (high luminance corresponding to pixel data zR2) is caused to correspond to pixel data DR2, a sum total of luminance of the sub-pixel SGx of the first sub-frame (high luminance corresponding to pixel data ZG2) and luminance of sub-pixel SGx of the second sub-frame (low luminance corresponding to pixel data zG2) is caused to correspond to pixel data DG2, and a sum total of luminance of the sub-pixel SBx of the first sub-frame (low luminance corresponding to pixel data ZB2) and luminance of sub-pixel SBx of the second sub-frame (high luminance corresponding to pixel data zB2) is caused to correspond to pixel data DB2.

In addition, in the picture element EI, a sum total of luminance of the sub-pixel SRI of the first sub-frame (high luminance corresponding to pixel data ZR3) and luminance of the sub-pixel SRI of the second sub-frame (low luminance corresponding to pixel data zR3) is caused to correspond to the pixel data DR3, a sum total of luminance of the sub-pixel SGI of the first sub-frame (low luminance corresponding to pixel data ZG3) and luminance of the sub-pixel SGI of the second sub-frame (high luminance corresponding to pixel data zG3) is caused to correspond to the pixel data DG3, a sum total of luminance of the sub-pixel SBI of the first sub-frame (high luminance corresponding to pixel data ZB3) and luminance of the sub-pixel SBI of the second sub-frame (low luminance corresponding to pixel data zB3) is caused to correspond to the pixel data DB3, a sum total of luminance of the sub-pixel SRi of the first sub-frame (low luminance corresponding to pixel data ZR4) and luminance of sub-pixel SRi of the second sub-frame (high luminance corresponding to pixel data zR4) is caused to correspond to pixel data DR4, a sum total of luminance of the sub-pixel SGi of the first sub-frame (high luminance corresponding to pixel data ZG4) and luminance of sub-pixel SGi of the second sub-frame (low luminance corresponding to pixel data zG4) is caused to correspond to pixel data DG4, and a sum total of luminance of the sub-pixel SBi of the first sub-frame (low luminance corresponding to pixel data ZB4) and luminance of sub-pixel SBi of the second sub-frame (high luminance corresponding to pixel data zB4) is caused to correspond to pixel data DB4. Regarding the picture elements EY and EJ, they are illustrated in FIG. 21.

CONCLUSION

In the liquid crystal display device, when displaying input image data in which pixel data of a first frame related to a first color pixel of an upper side picture element of two picture elements which are neighboring in a vertical direction is first pixel data, and pixel data of a second frame related to a first color pixel of a lower side picture element of the two picture elements is second pixel data, luminance of a first sub-pixel which is provided in a first color pixel of a predetermined picture element of a liquid crystal panel is higher than luminance of a second sub-pixel which is close to the first sub-pixel in a vertical direction in the first color pixel, and a sum total of luminance of the first and second sub-pixels corresponds to the first pixel data in a display period of the first frame, and luminance of the second sub-pixel is higher than luminance of the first sub-pixel, and a sum total of luminance of the first and second sub-pixels corresponds to the second pixel data in a display period of the second frame.

In the liquid crystal display device, a ratio of a length of the predetermined picture element in the vertical direction to a length in the horizontal direction is 2.

In the liquid crystal display device, the third and fourth sub-pixels which are neighboring in the vertical direction are arranged so that the first sub-pixel and the fourth sub-pixel obliquely face each other, and the second sub-pixel and the third sub-pixel obliquely face each other in the second color pixel of the above-described predetermined picture element, and when displaying the input image data in which pixel data of the first frame related to the second color pixel of the lower side picture element of the two picture elements is the third pixel data, pixel data of the second frame related to the second color pixel of the upper side picture element of the two picture elements is the fourth pixel data, luminance of the fourth sub-pixel is higher than luminance of the third sub-pixel, and a sum total of luminance of the third and fourth sub-pixels corresponds to the third pixel data in the display period of the first frame, and luminance of the third sub-pixel is higher than luminance of the fourth sub-pixel, and a sum total of luminance of the third and fourth sub-pixels corresponds to the fourth pixel data in the display period of the second frame.

In the liquid crystal display device, luminance of the second sub-pixel is 20% or less of luminance of the first sub-pixel in the display period of the first frame, and luminance of the first sub-pixel is 20% or less of luminance of the second sub-pixel in the display period of the second frame.

In the liquid crystal display device, fifth and sixth sub-pixels which are neighboring in the vertical direction are arranged so that the first sub-pixel and the fifth sub-pixel are aligned in the horizontal direction, and the second sub-pixel and the sixth sub-pixel are aligned in the horizontal direction in the first color pixel of a picture element which is close to the predetermined picture element in the horizontal direction, and luminance of the sixth sub-pixel is higher than luminance of the fifth sub-pixel in the display period of the first frame, and luminance of the fifth sub-pixel is higher than luminance of the sixth sub-pixel in the display period of the second frame.

The present invention is not limited to the above-described embodiments, and modification examples which are obtained by appropriately changing the above-described embodiments based on general technical knowledge, or examples obtained by combining thereof are also included in the embodiments of the present invention.

INDUSTRIAL APPLICABILITY

The present invention is preferable for a large liquid crystal display device which displays an image with high frequency (100 Hz or more), in particular.

REFERENCE SIGNS LIST

LCD LIQUID CRYSTAL DISPLAY DEVICE
LCP LIQUID CRYSTAL PANEL
EX, EY, EI, EJ PICTURE ELEMENT
PRX, PGX, PBX PIXEL
SRX, SRx, SGX, SGx, SBX, SBx SUB-PIXEL
DCC DISPLAY CONTROL CIRCUIT
RCC RESOLUTION CONVERSION CIRCUIT
Gn SCANNING SIGNAL LINE
SR, SG, SB DATA SIGNAL LINE
CSn, CSn+1 HOLDING CAPACITOR WIRING
GD GATE DRIVER
SD SOURCE DRIVER

The invention claimed is:

1. A liquid crystal display device wherein, when displaying input image data in which pixel data of a first frame related to a first color pixel of an upper side picture element of two picture elements which are neighboring in a vertical direction is first pixel data, and pixel data of a second frame related to a first color pixel of a lower side picture element of the two picture elements is second pixel data, in a display period of the first frame, the first pixel data is displayed, without pixel data of the first frame related to the first color pixel of the lower side picture element of the two picture elements being displayed, such that luminance of a first sub-pixel which is provided in a first color pixel of a predetermined picture element of a liquid crystal panel is higher than luminance of a second sub-pixel which is close to the first sub-pixel in a vertical direction in the first color pixel, and a sum total of luminance of the first and second sub-pixels corresponds to the first pixel data, and in a display period of the second frame, the second pixel data is displayed, without pixel data of the second frame related to the first color pixel of the upper side picture element of the two picture elements being displayed, such that luminance of the second sub-pixel is higher than luminance of the first sub-pixel, and a sum total of luminance of the first and second sub-pixels corresponds to the second pixel data.

2. The liquid crystal display device according to claim 1, wherein third and fourth sub-pixels which are neighboring in a vertical direction are arranged so that a first sub-pixel and a fourth sub-pixel obliquely face each other, and a second sub-pixel and a third sub-pixel obliquely face each other in a second color pixel of the predetermined picture element, and wherein, when displaying the input image data in which pixel data of the first frame related to the second color pixel of the lower side picture element of the two picture elements is third pixel data, and pixel data of the second frame related to the second color pixel of the upper side picture element of the two picture elements is fourth pixel data, luminance of the fourth sub-pixel is higher than luminance of the third sub-pixel, and a sum total of luminance of the third and fourth sub-pixels corresponds to the third pixel data in a display period of the first frame, and luminance of the third sub-pixel is higher than luminance of the fourth sub-pixel, and a sum total of luminance of the third and fourth sub-pixels corresponds to the fourth pixel data in a display period of the second frame.

3. The liquid crystal display device according to claim 1, wherein luminance of the second sub-pixel is 20% or less of luminance of the first sub-pixel in the display period of the first frame, and wherein luminance of the first sub-pixel is 20% or less of luminance of the second sub-pixel in the display period of the second frame.

4. The liquid crystal display device according to claim 1, wherein fifth and sixth sub-pixels which are neighboring in the vertical direction are arranged so that the first sub-pixel and the fifth sub-pixel are aligned in the horizontal direction, and the second sub-pixel and the sixth sub-pixel are aligned in the horizontal direction in the first color pixel of a picture element which is close to the predetermined picture element in the horizontal direction, wherein luminance of the sixth sub-pixel is higher than luminance of the fifth sub-pixel in the display period of the first frame, and wherein luminance of the fifth sub-pixel is higher than luminance of the sixth sub-pixel in the display period of the second frame.

5. The liquid crystal display device according to claim 1, wherein a ratio of a length of the predetermined picture element in the vertical direction to a length in the horizontal direction is 2.

* * * * *